US006505008B2

(12) United States Patent
Abe

(10) Patent No.: US 6,505,008 B2
(45) Date of Patent: Jan. 7, 2003

(54) DEVELOPER CONTAINER, PROCESS CARTRIDGE, DEVELOPING DEVICE, AND IMAGE FORMING APPARATUS WITH TONER SENSOR WIPING MEMBER ORIENTATION

(75) Inventor: Daisuke Abe, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/138,331

(22) Filed: May 6, 2002

(65) Prior Publication Data

US 2002/0141767 A1 Oct. 3, 2002

Related U.S. Application Data

(63) Continuation of application No. 09/824,749, filed on Apr. 4, 2001, now abandoned.

(30) Foreign Application Priority Data

Apr. 7, 2000 (JP) ..... 2000-107243

(51) Int. Cl.[7] ..... G03G 15/08

(52) U.S. Cl. ..... 399/27; 399/27; 399/99; 399/61; 399/62; 399/63; 399/64; 399/65

(58) Field of Search ..... 399/27, 99, 61, 399/62, 63, 64, 65; 15/250.001, 250.19, 250.11, 97.1

(56) References Cited

U.S. PATENT DOCUMENTS 6,253,036 B1 6/2001 Karakama et al. ..... 399/27

6,377,759 B1 4/2002 Abe et al. ..... 399/27

FOREIGN PATENT DOCUMENTS

| | | |
|---|---|---|
| JP | 5-100571 | 4/1993 |
| JP | 2001-83794 | 3/2001 |

*Primary Examiner*—Joan Pendegrass
(74) *Attorney, Agent, or Firm*—Fitzpatrick, Cella, Harper & Scinto

(57) ABSTRACT

A developer container for containing a developer includes a detecting member for detecting a developer amount having an electrode member having a pair of input-side and output-side electrodes formed in parallel and in one plane at a predetermined interval and adapted to detect the capacitance between the electrodes, a measurement-side electrode that is in contact with the developer, and a reference electrode that is out of contact with the developer, the detecting member being provided on a side surface of the developer container. The container also includes a developer removing member for removing developer adhering to a detection surface of the detecting member, the developer removing member being attached to the developer conveying member and in contact with the detection surface of the detecting member so as to remove developer on the detection surface of the detecting member. The container also includes a developer conveying member for conveying the developer toward a developer bearing member, and an acting member acting by a torque of the developer removing member such that the developer removing member is held in contact with the detection surface in a predetermined orientation.

20 Claims, 22 Drawing Sheets

DEVELOPER CONTAINER, PROCESS CARTRIDGE, DEVELOPING DEVICE, AND IMAGE FORMING APPARATUS WITH TONER SENSOR WIPING MEMBER ORIENTATION

CROSS-REFERENCE TO RELATED APPLICATION

This application is a continuation of application Ser. No. 09/824,749, filed Apr. 4, 2001, now abandoned.

BACKGROUND OF THE INVENTION

1. Field of the Invention

The present invention relates to an electrophotographic image forming apparatus. Further, the present invention relates to a process cartridge, a developing device, a developer amount detecting system, and a developer container.

Examples of the electrophotographic image forming apparatus include an electrophotographic copying machine, an electrophotographic printer (e.g., an LED printer and a laser beam printer), and an electrophotographic facsimile apparatus.

A process cartridge is one in which at least one of charging means, developing means, and cleaning means, and an electrophotographic photosensitive member, are formed into an integral unit in the form of a cartridge that is detachably mountable to the main body of an electrophotographic image forming apparatus, or one in which at least developing means and an electrophotographic photosensitive member are formed into an integral unit in the form of a cartridge that is detachably mountable to the main body of an electrophotographic image forming apparatus.

2. Related Background Art

Conventionally, in electrophotographic image forming apparatuses using the electrophotographic image forming process, a process cartridge system has been widely adopted in which an electrophotographic photosensitive member and process means acting thereon are formed into an integral unit in the form of a cartridge that is detachably mountable to the main body of an image forming apparatus. In such a process-cartridge-type electrophotographic image forming apparatus, the user is enabled to replace the cartridge in person. Thus, in some apparatuses of this type, means is provided which informs the user of consumption of the developer.

In a conventional developer amount detecting device, two electrode bars are provided inside the developer container of the developing means, and a variation in the capacitance between the two electrode bars is detected to thereby detect whether there is any developer in the container. Further, Japanese Patent Application Laid-open No. 5-100571 discloses a developer amount detecting device which is provided with a developer detecting electrode member formed by interdigitating, instead of two electrode bars, two parallel electrodes arranged in parallel at a predetermined interval in one plate in a protrusion-and-recess-like fashion, the developer detecting electrode member being provided on the lower surface of the developer container. In this device, a variation in the capacitance between the parallel electrodes arranged in a planar fashion is detected to thereby detect whether there is any developer in the container.

The above-described developer amount detecting devices are designed to detect whether there is any developer in the developer container, and is used to detect a substantial reduction in the amount of developer immediately before it is used up.

If it is possible to successively detect the remaining amount of developer in the developer container, the user will be enabled to know to what degree the developer has been consumed, which will be very convenient for the user.

SUMMARY OF THE INVENTION

It is an object of the present invention to provide a developer container, a process cartridge, a developing device, and an image forming apparatus in which it is possible to successively detect the remaining amount of developer by the main body of the image forming apparatus.

Another object of the present invention is to provide a developer container, a process cartridge, a developing device, and an image forming apparatus in which it is possible to clean the surface of a developer detecting member.

Still another object of the present invention is to provide a developer container, a process cartridge, a developing device, and an image forming apparatus in which an improvement has been achieved in terms of efficiency in the attachment of a developer removing member.

A further object of the present invention is provide a developer container in which it is possible to remove developer adhering to the detection region of a detecting member capable of successively detecting the remaining amount of developer, and an electrophotographic image forming apparatus, a process cartridge, and a developing device which are provided with such a developer container.

A further object of the present invention is to provide a developer container in which there is no need for the operator to adjust the attaching orientation of the developer removing member at the time of assembly to thereby achieve an improvement in assembly efficiency, and an electrophotographic image forming apparatus, a process cartridge, and a developing device which are provided with such a developer container.

A further object of the present invention is to provide a developer container in which, even if the developer removing member is in contact with the detection region of the detecting member in an orientation different from a predetermined orientation, it is possible to correct it to the correct orientation through rotation of the developer removing member, and an electrophotographic image forming apparatus, a process cartridge, and a developing device which are provided with such a developer container.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

An electrophotographic image forming apparatus, a process cartridge, a developing device, and a developer container according to the present invention will now be described in detail with reference to the drawings.

First Embodiment

Description of Process Cartridge and Image Forming Apparatus Main Body

A process cartridge and an electrophotographic image forming apparatus according to the present invention will now be described in detail with reference to the drawings.

Figure 1:
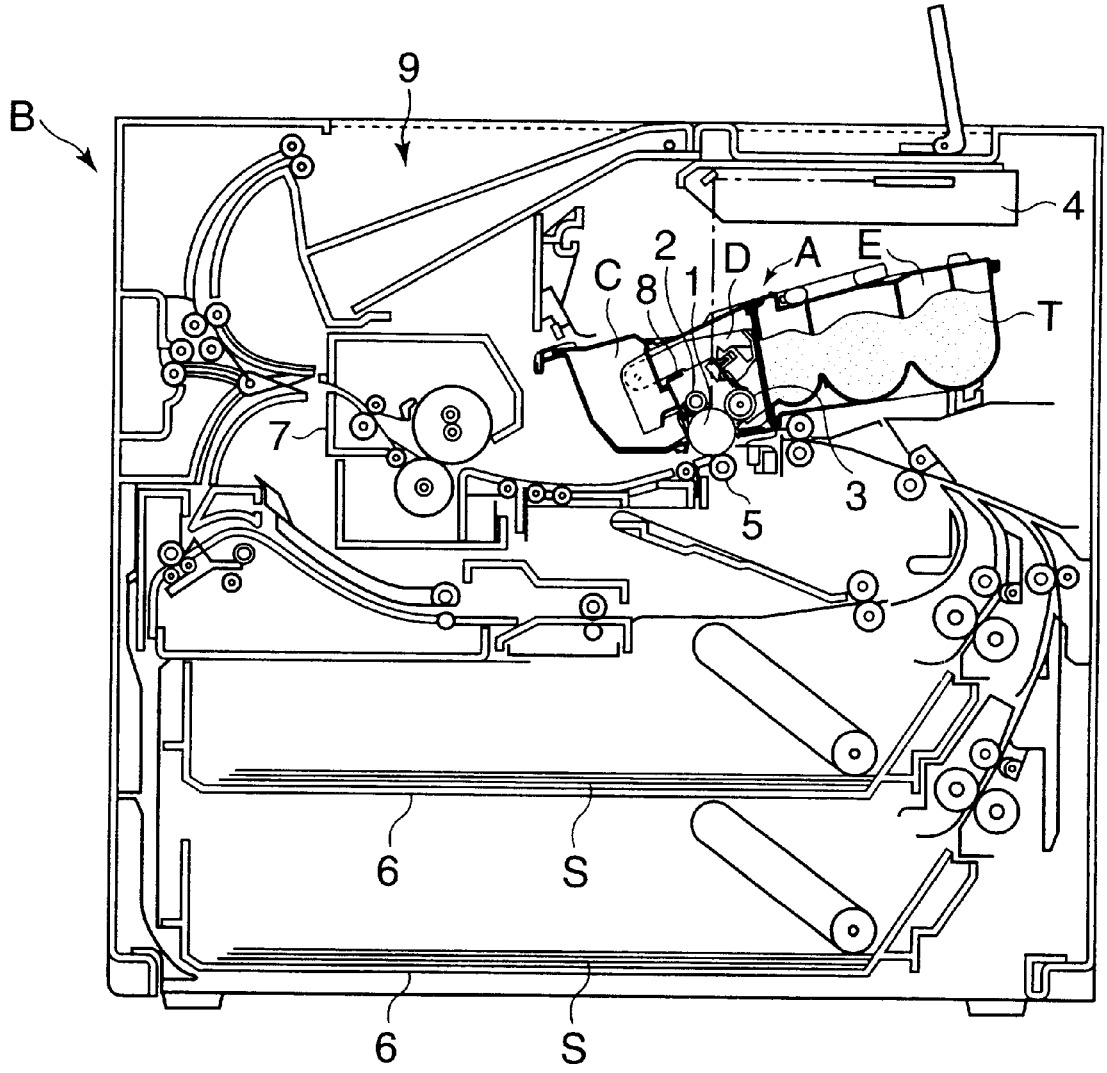
FIG. 1 is a schematic sectional view showing the construction of an electrophotographic image forming apparatus according to the present invention.

First, an embodiment of the electrophotographic image forming apparatus to which a process cartridge A constructed according to the present invention can be mounted, will be described with reference to FIG. 1. In this embodiment, the electrophotographic image forming apparatus consists of an electrophotographic laser beam printer B, which forms images on recording media, such as recording paper, OHP sheets, and cloth, by the electrophotographic image forming process.

The process cartridge A, which will be described in detail with reference to FIG. 2, comprises a drum-shaped electrophotographic photosensitive member, or a photosensitive drum 1, charging means 2 for uniformly charging the surface of the photosensitive drum 1, a roller-shaped developer bearing member serving as developing means opposed to the photosensitive drum 1, or a developing roller 3, a developing container D connected to the developing roller 3 and formed of a resin such as polystyrene, a developer container E serving as a developer containing portion containing developer, and a cleaning container C having cleaning means 8, these components being formed into an integral unit.

The laser beam printer B, serving as an image forming apparatus, includes a laser scanner 4 provided above the process cartridge A and adapted to apply a laser beam according to image information, and transfer means 5 provided below the process cartridge A and opposed to the photosensitive drum 1. In the image forming apparatus constructed as described above, image formation is performed as follows.

First, the photosensitive drum 1 is uniformly charged by the charging means 2, and its surface is scanned by and exposed to the laser beam applied by the laser scanner 4, thereby forming an electrostatic latent image of the target image information. By the action of the developing roller 3, some developer T in the developer container D adheres to the electrostatic latent image to thereby visualize the image. In this embodiment, an insulating magnetic monocomponent developer (toner) is used as the developer. However, the developer is not restricted to this type of developer. Any type of developer will do as long as it is a magnetic developer or an insulating magnetic developer.

The image on the photosensitive drum 1 is transferred to a recording sheet S fed and conveyed from a feed cassette 6, by the transfer means 5. The recording sheet S is passed through fixing means 7, whereby the image is fixed to the recording sheet S, which is then discharged onto a discharge tray 9 outside the main body. After the developer image has been transferred to the recording sheet S, developer T remaining on the photosensitive drum 1 is removed by the cleaning means 8, and collected in the cleaning container C.

Figure 3:
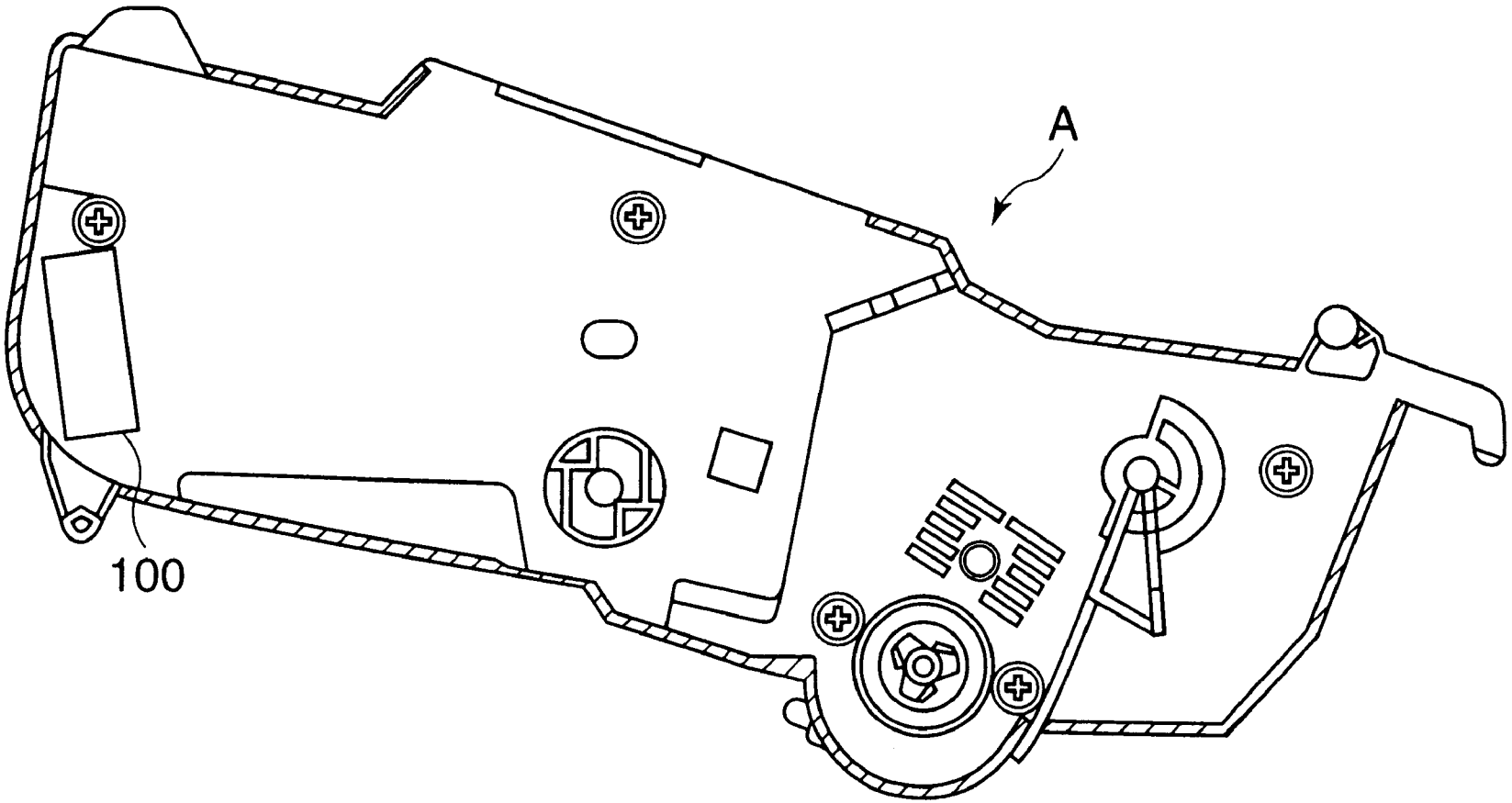
FIG. 3 is a side view of a process cartridge according to the present invention, illustrating the arrangement of a memory unit.

Further, as shown in FIG. 3, a memory unit 100 serving as memory means is mounted in the process cartridge A. In this embodiment, the memory unit 100 is attached to a side surface of the process cartridge A.

General System Configuration

Figure 20:
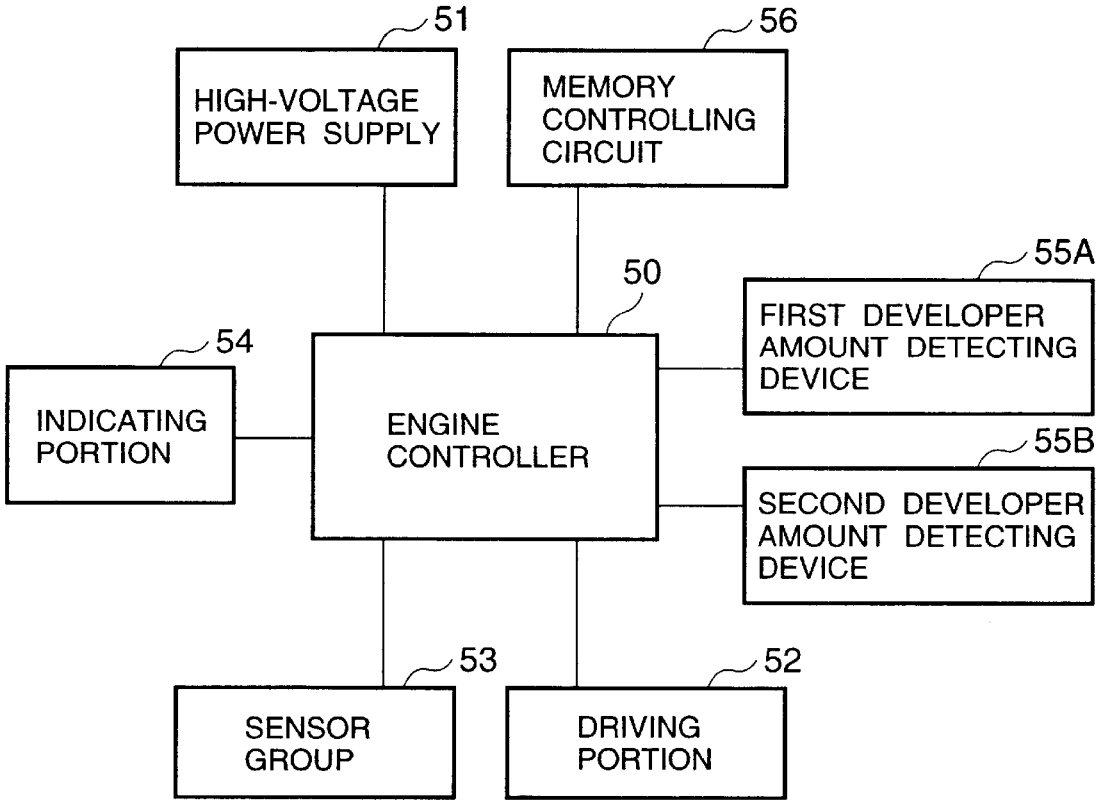
FIG. 20 is a system block diagram of an image forming apparatus according to the present invention.

Next, the system configuration of the image forming apparatus of this embodiment will be described with reference to the system block diagram of FIG. 20.

There is provided an engine controller 50 for performing system control on the entire image forming apparatus, and a central processing unit (CPU) (not shown) is arranged inside the engine controller 50. A series of system processing operations of the image forming apparatus are conducted in accordance with a program stored in the central processing unit beforehand.

A high-voltage power supply 51 generates a charging bias to be supplied to the charging means 2 and consisting of a DC voltage and an AC voltage superimposed thereon, a developing bias to be supplied to the developing roller 3 and consisting of a DC voltage and an AC voltage superimposed thereon, a transfer bias which is a DC voltage to be supplied to the transfer means 5, and a fixing bias which is a DC voltage to be supplied to the fixing means 7.

Further, in the system configuration of this embodiment, there are provided a driving portion 52 including a motor, a solenoid, etc. provided inside the apparatus, a sensor group 53 provided at a predetermined position inside the image forming apparatus, an indicating portion 54 indicating the state of the apparatus, and first and second developer amount detecting devices 55A and 55B for detecting the capacitance of a developer detecting member in the process cartridge A to thereby detect the developer amount, the components being controlled by an engine controller 50. Further, connected to the engine controller 50 is a memory controlling circuit 56 for controlling the memory unit 100 attached in the process cartridge.

Description of Memory Unit

The memory unit 100, which is attached to a side surface of the process cartridge A in this embodiment as shown in FIG. 3, will be described.

The memory unit 100 contains a nonvolatile built-in memory element, and is capable of writing and reading data through data communication with the image forming apparatus main body. All the control of the data communication is performed by the memory controlling circuit 56. The data communication is effected in a non-contact fashion through magnetic coupling between an antenna provided in the memory unit 100 and an antenna provided in the image forming apparatus main body. When the process cartridge A is mounted to the laser printer B, the antenna of the memory unit 100 and the antenna provided in the laser printer 100 are brought close to each other, whereby communication is possible. Further, a power supply circuit is provided inside the memory unit 100, and all the DC power used inside is supplied from this power supply circuit. In the power supply circuit, the electric current generated in the two antennas as a result of magnetic coupling of the antennas is rectified, thereby generating a DV voltage. The memory unit 100 stores information on the process cartridge A, etc.

Construction of Process Cartridge

Figure 2:
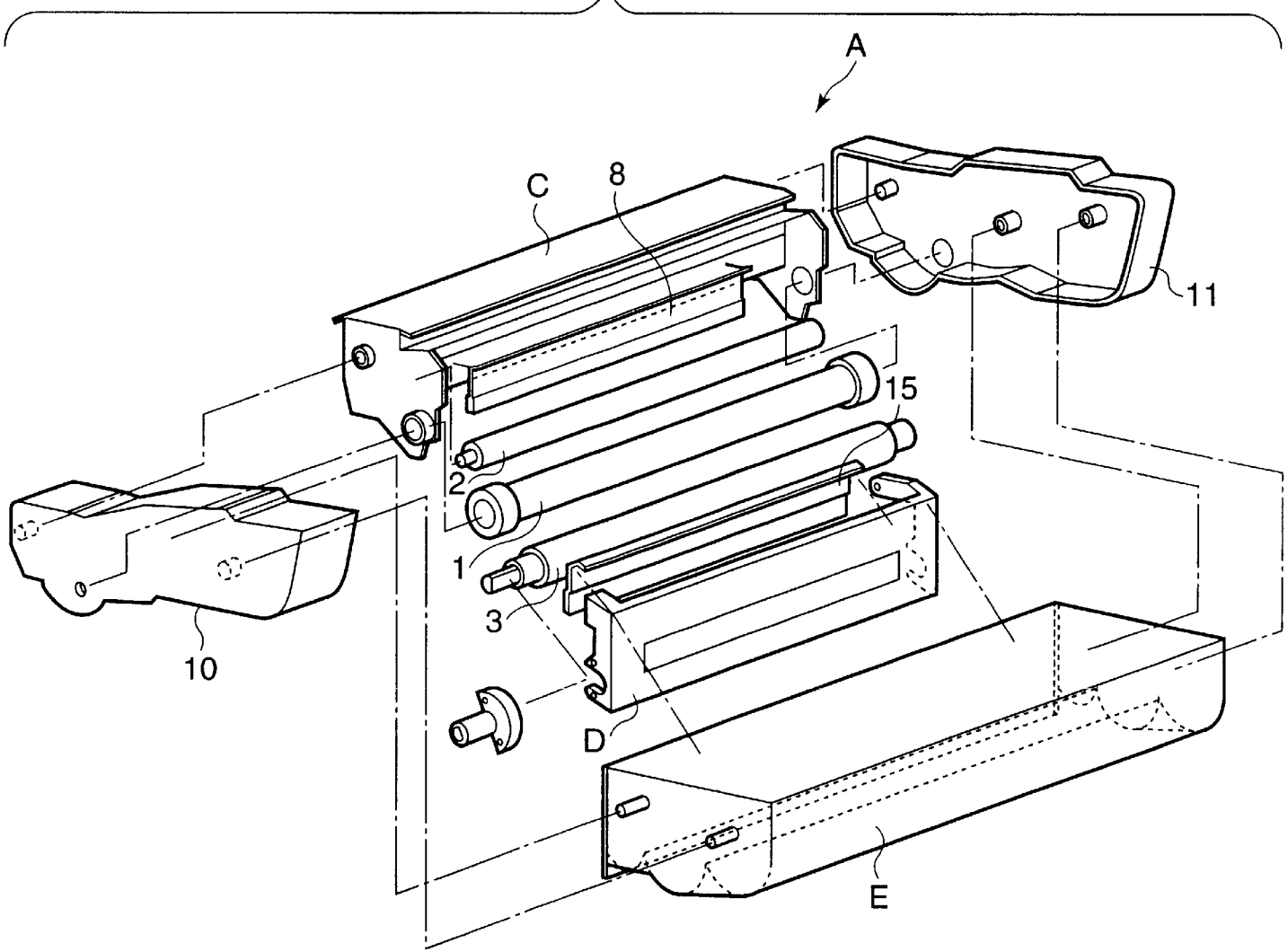
FIG. 2 is an exploded perspective view showing the construction of a process cartridge according to the present invention.
Figure 4:
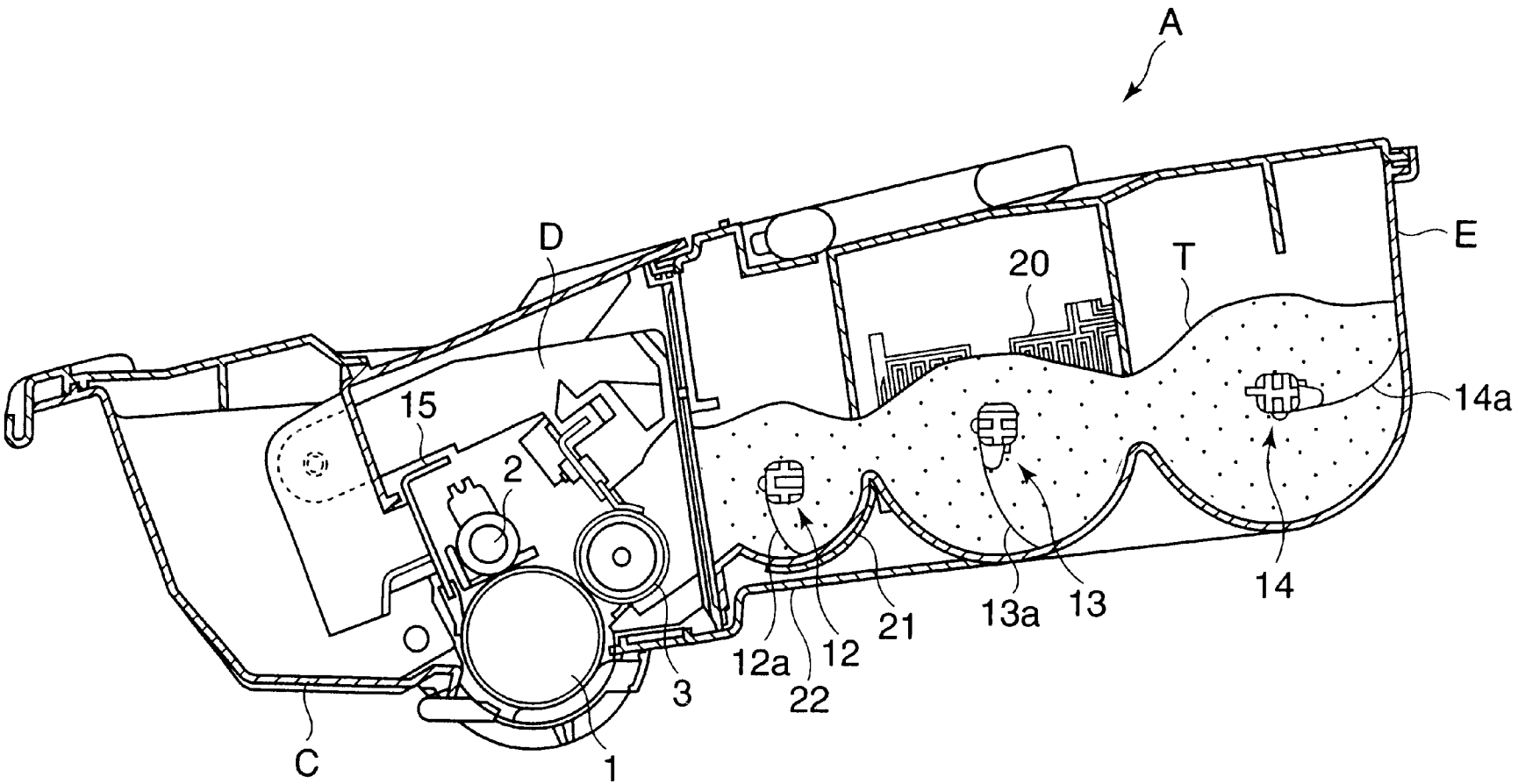
FIG. 4 is sectional view of a process cartridge according to the present invention.

FIG. 2 is an exploded perspective view of the process cartridge A of this embodiment, and FIG. 4 is a sectional view of the process cartridge A.

Referring to FIG. 2, the process cartridge A of this embodiment includes the developer container E containing developer, the developing container D holding the developing roller 3 serving as the developing member, the cleaning container C holding the photosensitive drum 1 and the cleaning means 8, and side covers 10 and 11 retaining the developer container E and the cleaning container C, the containers being connected with each other to form an integral cartridge.

Referring to FIG. 4, the developer container E is formed so as to be horizontally elongated in order to meet the demand for an increase in capacity, and the bottom surface of the developer container E has three recesses. Three conveying members 12, 13, and 14, which are driven by a main body motor (not shown), as provided in correspondence with the recess of the developer container E. By agitating wing members 12*a*, 13*a*, and 14*a* provided in the conveying members 12, 13, and 14, the developer T is conveyed to the developing container D.

By forming the developer container E in a horizontally elongated configuration, the self-weight of the developer T can be reduced, so that it is possible to mitigate fading, a deterioration in the developer, an increase in the agitating torque, etc.

The agitating wing members 12*a* through 14*a* are formed of sheets of a resin such as polyethylene terephtalate or polyphenylene sulfide, and are adapted to perform the agitation and conveyance of the developer T. The rotation radius of each of the distal ends of the agitating wing members 12*a* through 14*a* is larger than the radius of the bottom surface of the developer container E, and the distal ends rub on the bottom surface of the developer container E, whereby the developer T is horizontally conveyed without leaving any of it on the bottom surface of the developer container E.

Construction of Developer Amount Detecting Member

As shown in FIG. 4, in this embodiment, there are provided a first detecting member 20 and a second detecting member 21 to successively detect the developer amount. The first detecting member 20 is used to perform detection in a region where the amount of developer T is relatively large, and the second detecting member 21 is used to perform detection in a region where the amount of developer T is relatively small.

More specifically, the first detecting member 20 performs detection from the initial stage of use to the stage were the amount of developer is approximately 50 to 10%, and the second detecting member 21 performs detection from the stage where the amount of developer is approximately 50 to 10% to the stage where there is no developer left. Both the first detecting member 20 and the second detecting member 21 perform developer amount measurement by measuring capacitance.

Figure 5A:
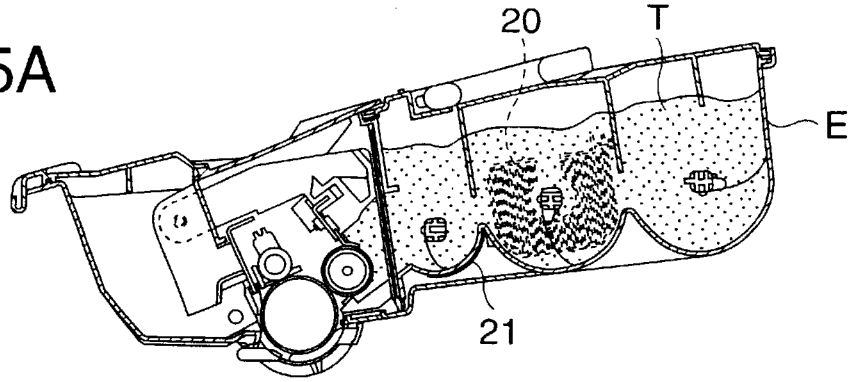
FIGS. 5A, 5B, 5C, and 5D are sectional views of a developer container, showing how developer is consumed.
Figure 5B:
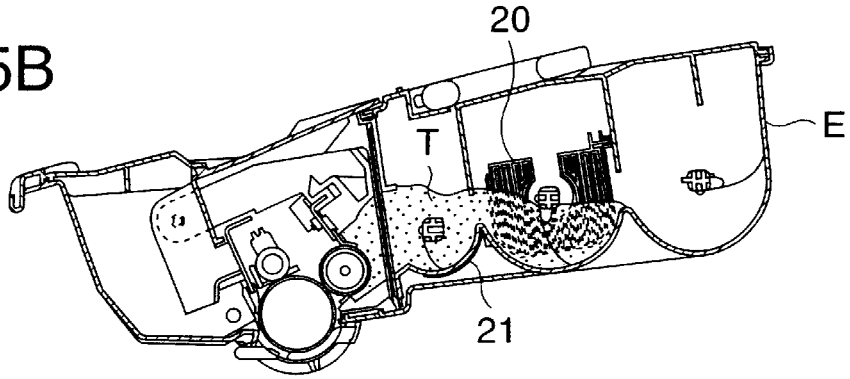
Figure 5C:
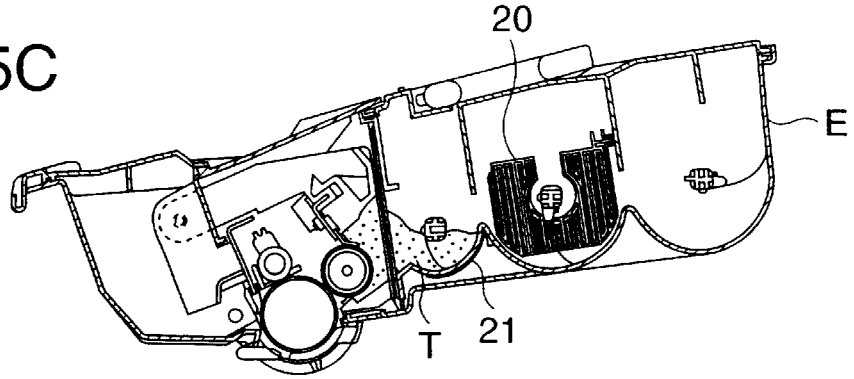
Figure 5D:
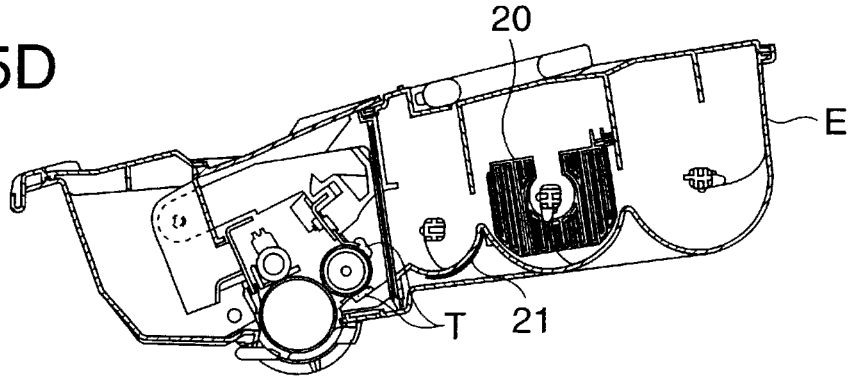
Figure 6:
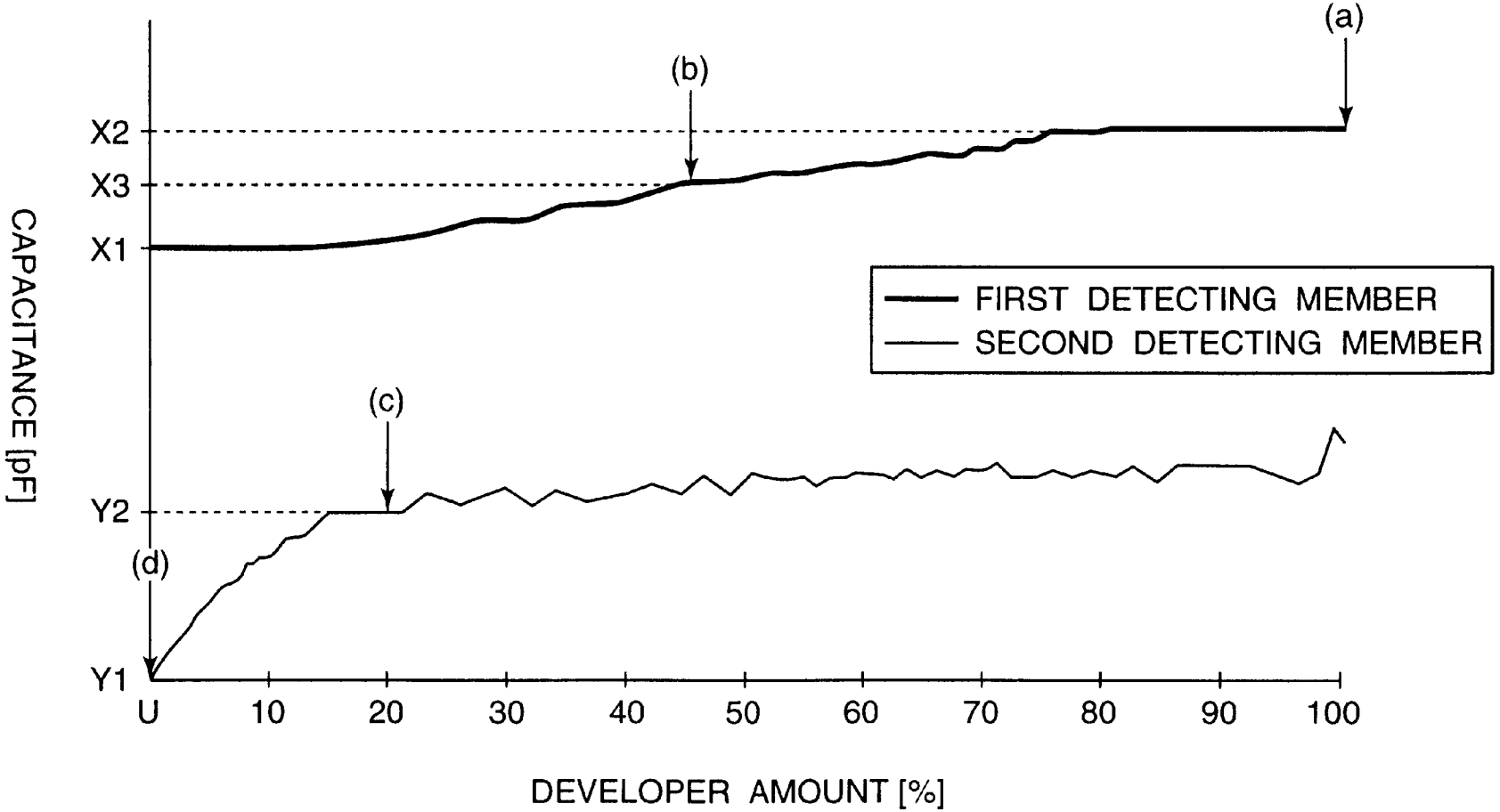
FIG. 6 is a graph showing the relationship between developer amount and capacitance in the developer amount detecting device of the present invention.

FIGS. 5A, 5B, 5C, and 5D show how the developer amount changes, and FIG. 6 shows the relationship between the developer amount and the capacitance. In this embodiment, the transition from the first detecting member 20 to the second detecting member 21 is effected when the developer amount has been reduced to approximately 20%. FIGS. 5A, 5B, 5C, and 5D are respectively in correspondence with points (a), (b), (c), and (d) in FIG. 6.

Point (a) indicates the stage at which the amount of developer is 100%, with both the first detecting member 20 and the second detecting member 21 being buried in the developer (FIG. 5A). At this time, the output of the first detecting member 20 is X2.

Point (b) indicates the stage at which the amount of developer in the detection region for the first detecting member 20 varies as the developer is gradually consumed (FIG. 5B). As the area of the developer that is in contact with the surface of the first detecting member 20 varies, the output varies. At this time, the output of the first detecting member 20 is X3.

Point (c) indicates the stage at which the amount of developer has been reduced to approximately 20%, causing the second detecting member 21 to start operation (FIG. 5C). At this time, the output of the second detecting member 21 is Y2.

Point (d) indicates the stage at which detection is performed until the amount of developer becomes 0% (FIG. 5D). At this time, the output of the second detecting member 21 is Y1. Thus, successive detection is possible throughout the entire range, i.e., from the initial to the last stage of use of the process cartridge A.

Principle and Construction of First Detecting Member

Next, the operating principle of the first and second detecting members 20 and 21 will be described. First, FIG.

7 shows the first detecting member 20. FIG. 8 is a view of the first detecting member 20 as seen from a direction opposite to that of FIG. 7. FIG. 9 is a developed diagram showing the first detecting member 20. Referring to FIG. 9, the first detecting member 20 includes a measurement side output electrode 22*a*, a reference side output electrode 22*c*, and a common input electrode 22*b*. A combination of the measurement side output electrode 22*a* and the common input electrode 22*b* serves as a measurement electrode 20*a*, and a combination of the reference side output electrode 22*c* and the common input electrode 22*b* serves as a reference electrode 20*b*.

Figure 7:
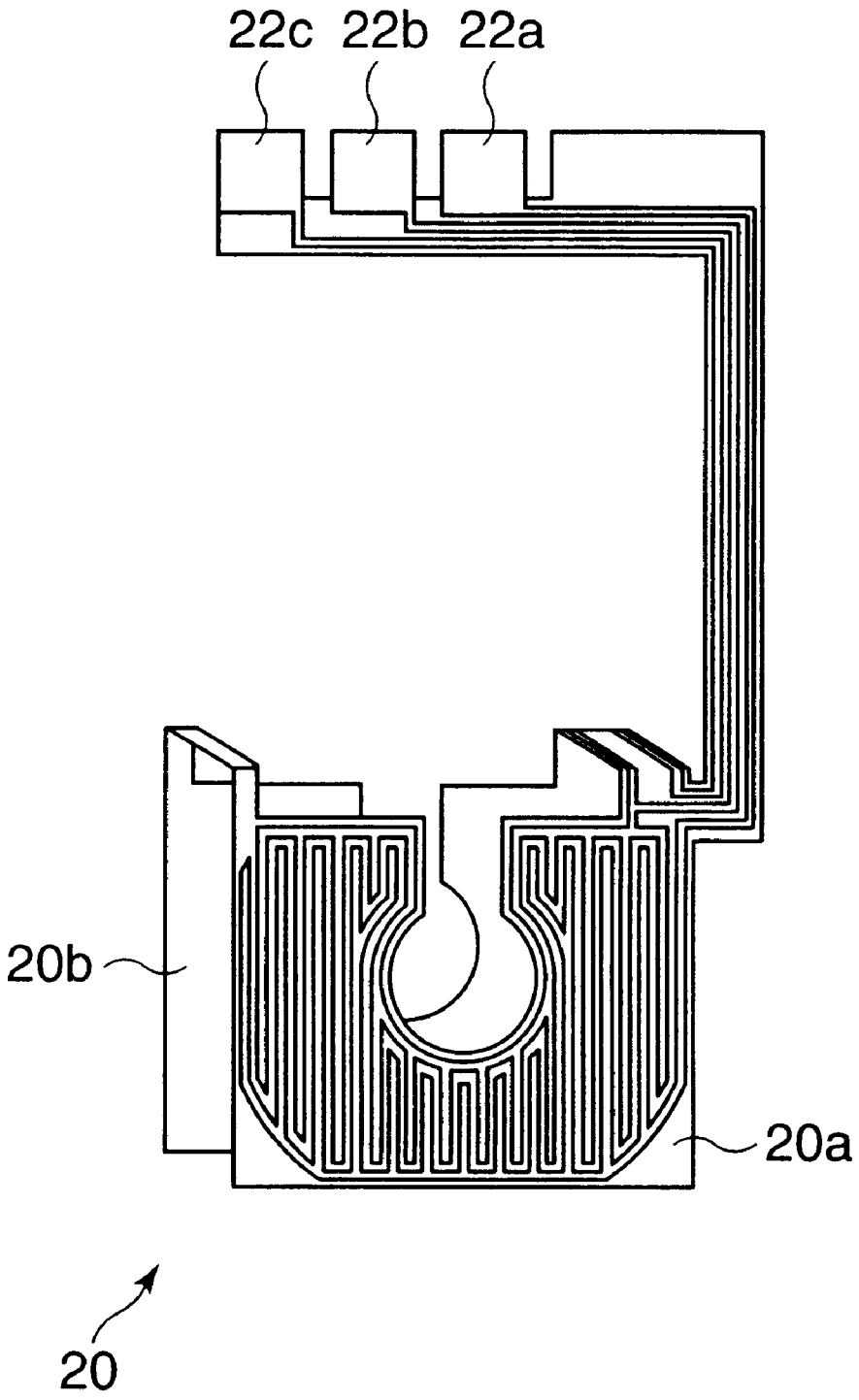
FIG. 7 is a perspective view of a first detecting member in the present invention.
Figure 8:
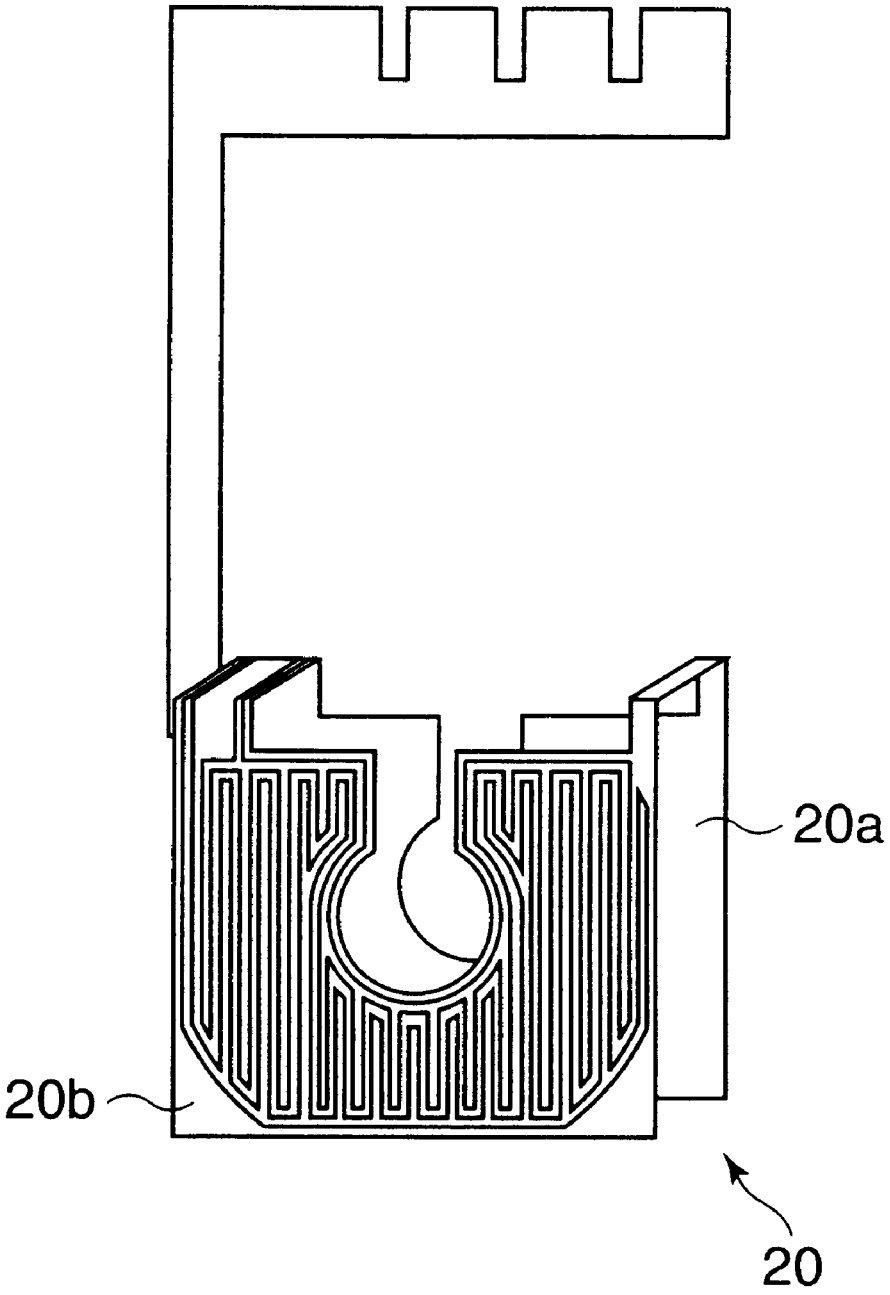
FIG. 8 is a perspective view of the first detecting member in the present invention.
Figure 9:
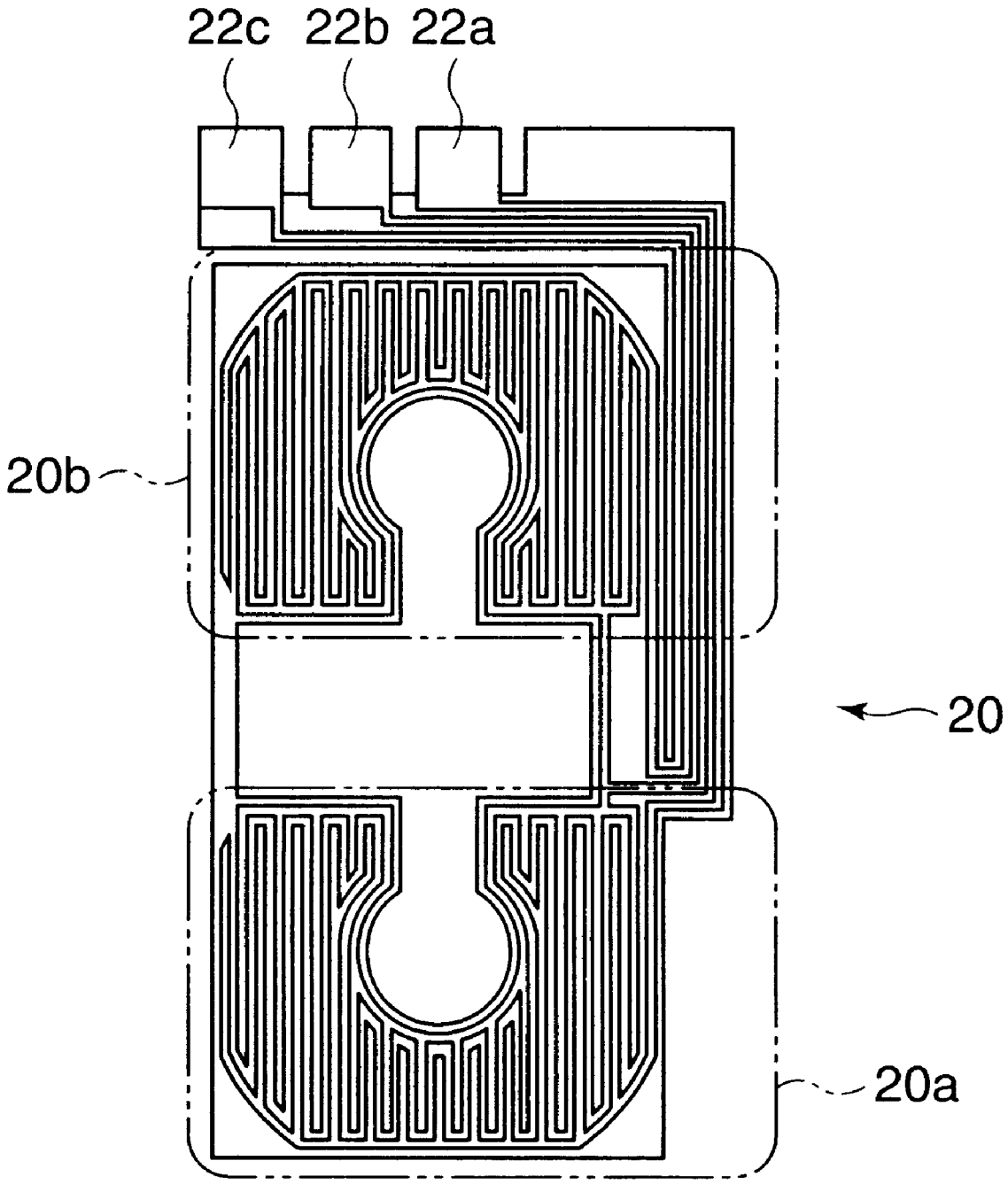
FIG. 9 is a developed view of the first detecting member in the present invention.

Referring to FIGS. 7 and 8, the measurement electrode 20*a* is arranged at a position in the developer container E, such as an inner side surface thereof, where it is in contact with the developer T. By measuring the capacitance between the pair of electrodes 22*a* and 22*b*, it is possible to detect a variation in the area of the developer that is in contact with the electrode surface, thereby making it possible to ascertain the amount of developer in the developer container E. That is, since the dielectric constant of the developer T is larger than that of air, a change in the area of the portion of the surface of the first detecting member 20 that is in contact with the developer T results in a change in the capacitance between the electrodes 22*a* and 22*b*.

The reference electrode 20*b* is arranged at a position in the developer container E where the reference electrode 20 is out of contact with the developer T, and is designed so as to exhibit a change in capacitance similar to that of the measurement electrode 20*a* when environmental conditions are changed. In this embodiment, the electrode pattern configuration of the measurement electrode 20*a* is the same as that of the reference electrode 20*b*. Thus, by subtracting the value of the capacitance of the reference electrode 20*b* from the value of the capacitance of the measurement electrode 20*a*, it is possible to assume that there is no variation in capacitance due to environmental conditions, thereby achieving an improvement in terms of detection accuracy.

As shown in FIG. 9, the first detecting member 20 is preferably formed by providing the measurement electrode 20*a* and the reference electrode 20*b* on one side of a single flexible board, such as a flexible print board, which is folded and arranged inside the developer container E. When attaching the first detecting member 20, an adhesive double coated tape or the like is used and its edges or the entire back surface thereof is secured to the developer container E so that no developer may be allowed to get behind the measurement electrode 20*a*.

Arrangement of First Detecting Member

Figure 10:
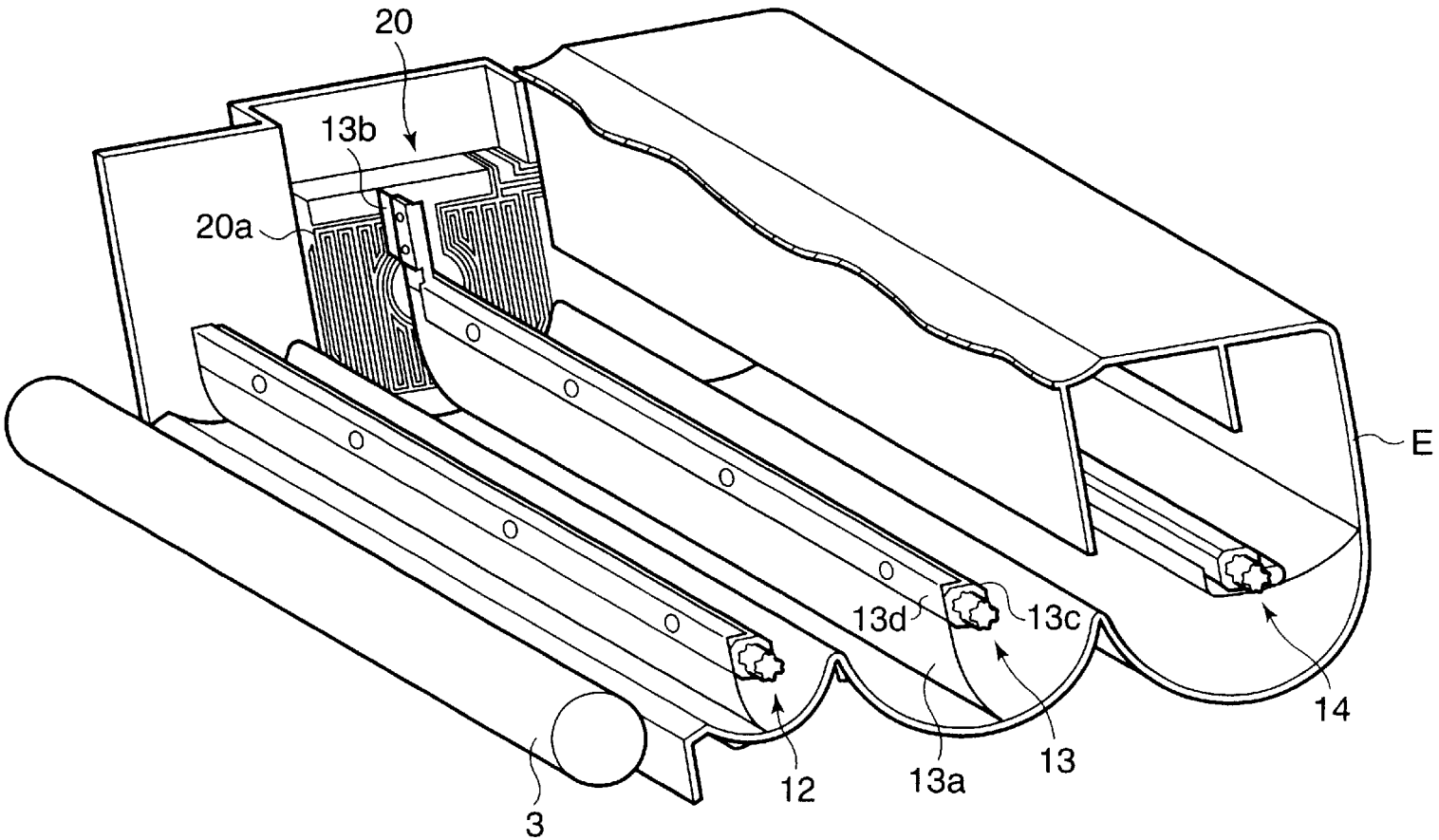
FIG. 10 is a perspective view of a developer container in the present invention.

FIG. 10 is a perspective view of the developer container E. The developer container E is provided with three conveying members 12, 13, and 14. The first detecting member 20 is arranged in the region where the conveying member 13, which is the second conveying member as counted from the developing roller 3 side, is arranged. In this region, the developer T is conveyed to the acting region for the second detecting member 21 described below.

That is, in this embodiment, the first detecting member 20 is arranged upstream of the second detecting member 21 in a developer supplying direction in which the developer T contained in the developer container E is supplied toward the developing roller 3.

Further, the first detecting member 20 is arranged on the side wall on the driving side in the developer container E so as to surround the shaft of the conveying member 13. By arranging the first detecting member 20 at this position, it is possible to reduce the area of the first detecting member 20 while realizing successive detection, so that it is possible to achieve a reduction in parts cost. Further, by positioning it so as to be spaced apart from the developing roller 3, it is possible to minimize the influence of the developing bias.

The first detecting member 20 exhibits very high sensitivity in the vicinity of the surface thereof. Thus, to enhance the detection accuracy, it is effective to provide a surface wiping member 13*b* as means for removing the developer on the surface thereof. When doing so, to simplify the construction, it is desirable to provide the surface wiping member 13*b* on the developer conveying member 13. In this case, the first detecting member 20 is arranged in the range which corresponds to the developer agitating region and in which the wiping member 13*b* functions.

Construction of Wiping Member

As shown in FIG. 10, in this embodiment, the surface wiping member 13*b* for the first detecting member 20 is provided on the developer conveying member 13. The wiping member 13*b* is provided only on the conveying member 13, which is at the position where the first detecting member 20 is provided.

The developer conveying member 13 has an agitating bar member 13*c*, an agitating wing member 13*a*, an agitating wing holding member 13*d*, and the wiping member 13*b*. The agitating bar member 13*c* is rotatably supported by the developer container E. The agitating wing member 13*a* is pressed against the agitating bar member 13*c* and fastened thereto by the agitating wing holding member 13*d*. The agitating wing holding member 13*d* is formed of sheet metal or resin and is fastened to the agitating bar member 13*c* by heat caulking, ultrasonic welding, adhesion or the like. Like the agitating wing member 13*a*, the wiping member 13*b* is secured in position by the agitating wing holding member 13*d*. The agitating wing member 13*a* is formed of a resin material, such as polyethylene terephthalate or polyphenylene sulfide. The wiping member 13*b* may be formed of a resin sheet material, such as polyethylene terephthalate or polyphenylene sulfide, or rubber or foam material. That is, the material for the wiping member 13*b* can be arbitrarily selected as long as it is suitable for the wiping of the surface of the first detecting member 20.

Figure 11:
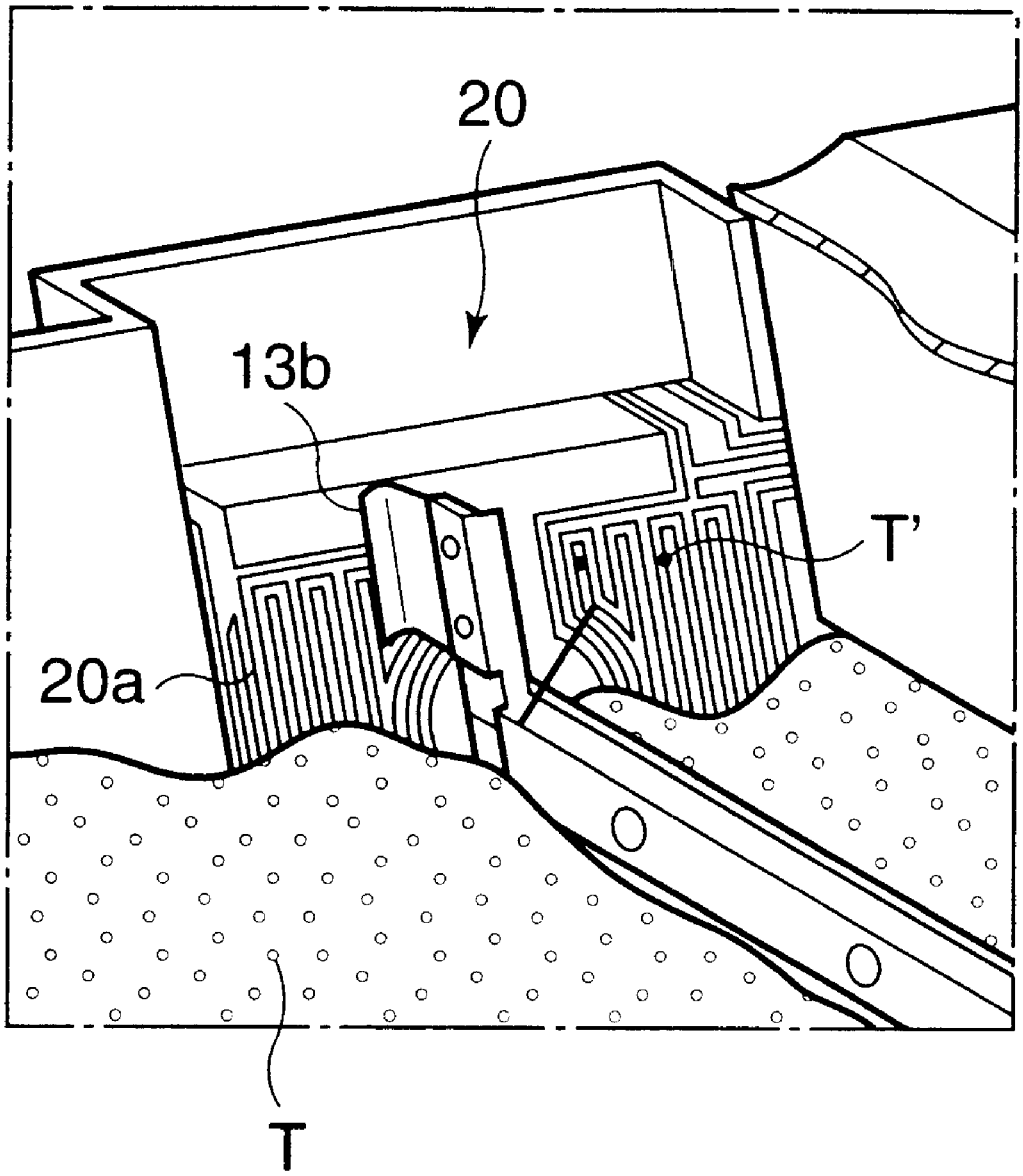
FIG. 11 is a perspective view showing the manner of operation of a wiping member in the present invention.

FIG. 11 shows the first detecting member 20 in a state in which the developer has been consumed to some extent. In this state, there exists adhering developer T', which is above the developer surface. The existence of the adhering developer T' leads to an increase in the capacitance of the measurement electrode 20*a* of the first detecting member 20, resulting in discrepancies.

In view of this, the first measurement electrode 20*a* is wiped by the wiping member 13*b*, whereby any adhering developer which is above the developer surface is removed, thereby making it possible to enhance the detection accuracy.

Process for Detecting Capacitance by First Detecting Member

Next, capacitance detection by the first detecting member 20 will be described in detail. In the developer amount detection system of this embodiment, the first detecting member 20, which serves as a first capacitance generating portion, is connected to the first developer amount detecting device 55A shown in FIG. 20, where the capacitance of the first detecting member 20 is detected.

Figure 21:
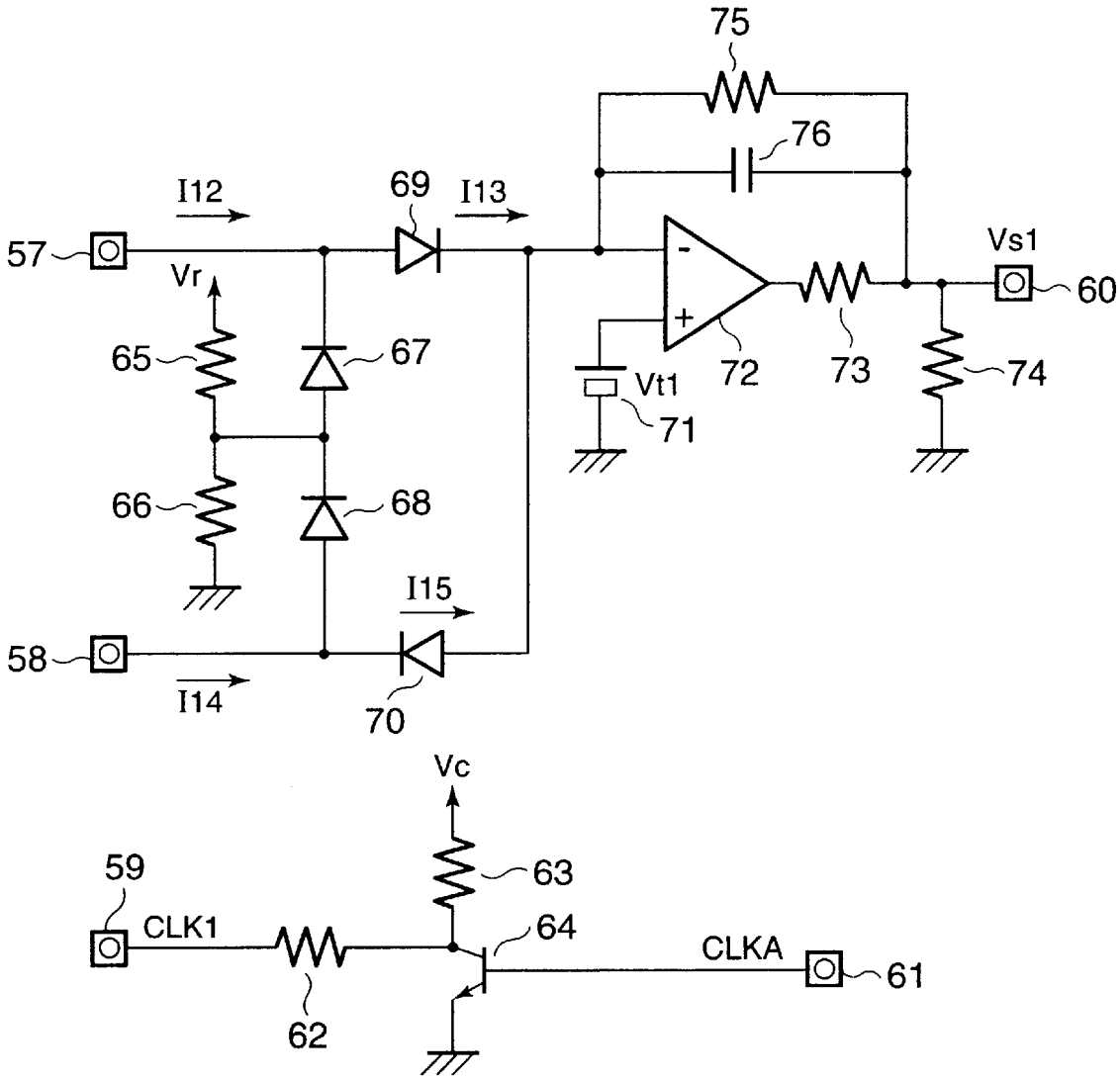
FIG. 21 is an inner circuit diagram of a first developer amount detecting device of the present invention.

FIG. 21 is a diagram showing the inner circuit configuration of the developer amount detecting device 55A. A terminal 59 is connected to the electrode 22*b* of the first detecting member 20 via an electric contact (not shown) whose contact portion is exposed through the cartridge frame, and outputs a developer amount detection clock CLK1. The clock CLK1 is generated by resistors 62 and 63, and a transistor 64. A signal CLKA is a clock output from the engine controller 50; it is a rectangular wave having a frequency fc of 50 KHz and a duty of 50%. The signal CLKA is amplified to an amplitude Vc by the transistor 64 before it is output from the terminal 59 as clock CLK1.

A terminal 57 is connected to the measurement side output electrode 22*a* of the first detecting member 20 via an electric contact (not shown) whose contact portion is exposed through the cartridge frame. When the clock CLK1 output from the terminal 59 is applied to the measurement side output electrode 22*b*, an AC electric current I12 flows through the terminal 57 due to the capacitance Ct between the electrodes 22*a* and 22*b*. Here, the magnitude of the AC current I12 is of a value corresponding to the capacitance value Ct. The AC current I12 is rectified by diodes 69 and 67 provided in the input portion of the terminal 57, and a current I13 obtained through rectification is input to an integration circuit formed by an operation amplifier 72, a resistor 75, and a capacitor 76. Here, the current I13 is a one-direction component current (hereinafter referred to as "half-wave current") of the current I12.

A terminal 58 is connected to the reference side output electrode 22*c* of the first detecting member 20 via an electric contact (not shown) whose contact portion is exposed through the cartridge frame. Due to the clock CLK1 output from the terminal 59, a current I14 of a magnitude corresponding to the capacitance Cr between the electrodes 22*b* and 22*c* flows through the terminal 58. The current I14 is rectified by diodes 68 and 70 set in a direction opposite to that of the input portion of the terminal 57, and a current I15 is input to the integration circuit. The current I15 is a half-wave current of a polarity opposite to that of the current I13. The current I13 and the current I15 that are input to the integration circuit are integrated, and a DV voltage Vd1 corresponding to the average value of the sum total current of I13 and I15 is generated across the resistor 75. Assuming that the resistance value of the resistor 75 is Rs1, the voltage Vd1 can be approximated by the following equation.

$$Vd1 = Rs1 \times fc \times Vc \times (Ct - Cr) \quad (1)$$

A predetermined reference voltage Vt1 is input from a power supply 71 to the positive input terminal of the operation amplifier 72, and the output voltage Vs1 of the operation amplifier 72 has a characteristic that can be expressed by the following equation.

$$Vs1 = Vt1 - Rs1 \times fc \times Vc \times (Ct - Cr) \quad (2)$$

As shown by the above equation, the output voltage Vs1 of the operation amplifier 72 has a voltage value corresponding to the difference between the capacitance between the electrodes 22*a* and 22*b* on the measurement electrode 20*a* side and the capacitance between the electrodes 22*c* and 22*b* on the reference electrode 20*b* side, that is, the amount of developer in the process cartridge A. The output voltage Vs1 of the operation amplifier is output from an output terminal 60.

The terminal 60 is connected to the analog-digital conversion terminal of the central processing unit in the engine controller 50. The voltage level Vs1 corresponding to the amount of developer is converted to digital data and, further, compared with a conversion table previously stored in the engine controller 50, whereby it is converted to the amount T1 of developer in the process cartridge A.

Construction and Arrangement of Second Detecting Member

Figure 12:
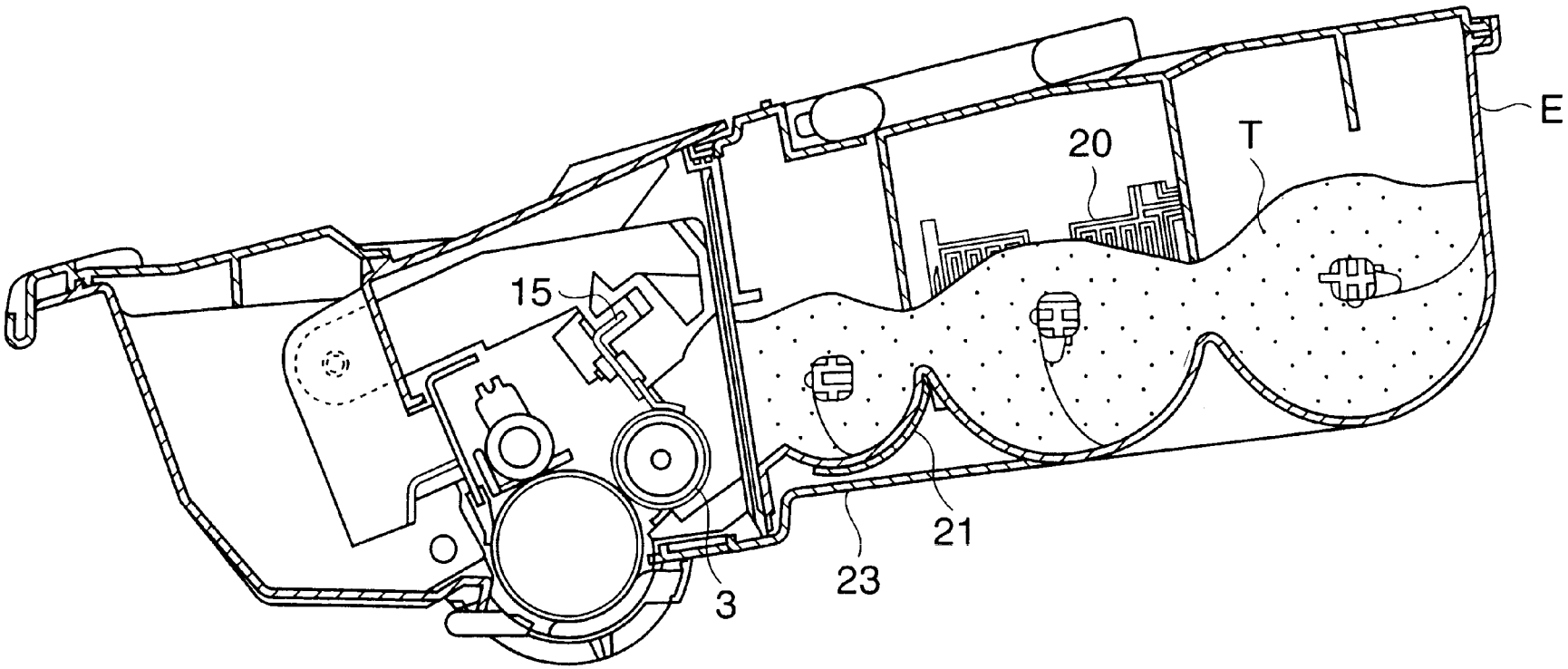
FIG. 12 is a sectional view of a process cartridge, illustrating a second detecting member in the present invention.
Figure 13:
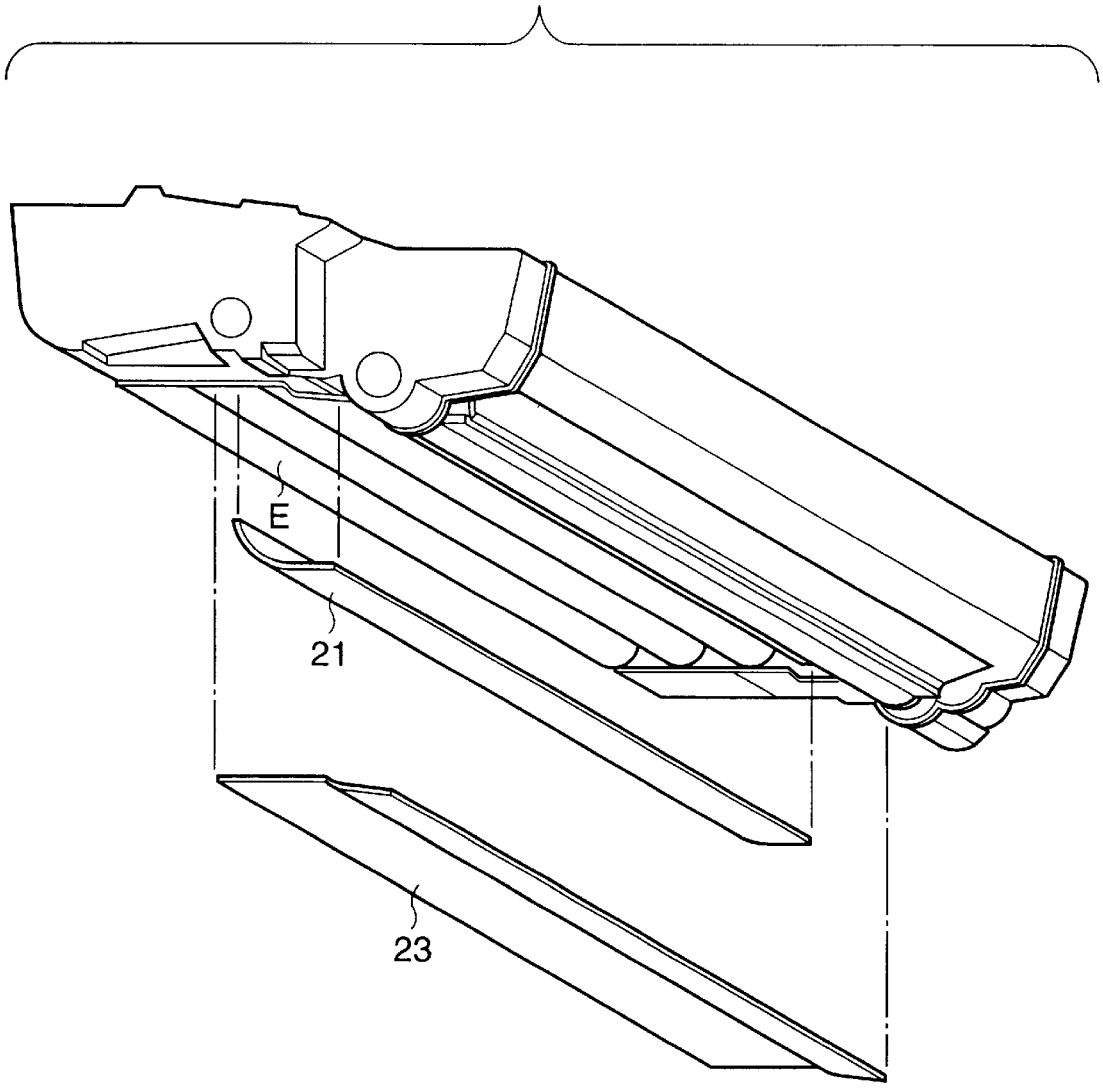
FIG. 13 is a perspective view, as seen from below, of the process cartridge, illustrating the arrangement position of the second detection member.

FIG. 12 is a sectional view of the developer container E, and FIG. 13 is a bottom view of the developer container E. The second detecting member 21 is provided outside the developer container E and, further, a cover member 23 is provided on the outer side thereof.

The second detecting member 21 is formed of sheet metal, and extends over the entire longitudinal range of the bottom surface E of the developer container E so as to be in conformity with the outside protrusion or the inside recessed configuration of the bottom surface of the container. The developing roller 3 is electrically connected to a developer regulating member supporting member 15, and a variation in the capacitance between the second detecting member 21, the developing roller 3, and the developer regulating member supporting member 15 is measured to thereby detect the developer amount.

The second detecting member 21, which is arranged outside the developer container E, is fastened to the recess of the developer container E, which is nearest to the developing roller 3 by caulking, adhesion or the like. Due to the provision of the second detecting member 21 outside the developer container E, there is no need for wiring that leads to the contact connected to the image forming apparatus main body to run inside the developer container E, so that there is no fear of developer leakage.

Process for Detecting Capacitance by Second Detecting Member

Next, the capacitance detecting process using the second detecting member 21 will be described in detail. In the developer amount detection system of this embodiment, the second detecting member 21 serving as the second capacitance generating portion is connected to the second developer amount detecting device 55B of FIG. 20, and the value of the capacitance between the second detecting member 21, the developing roller 3, and the developer regulating member supporting member 15 is detected.

Figure 22:
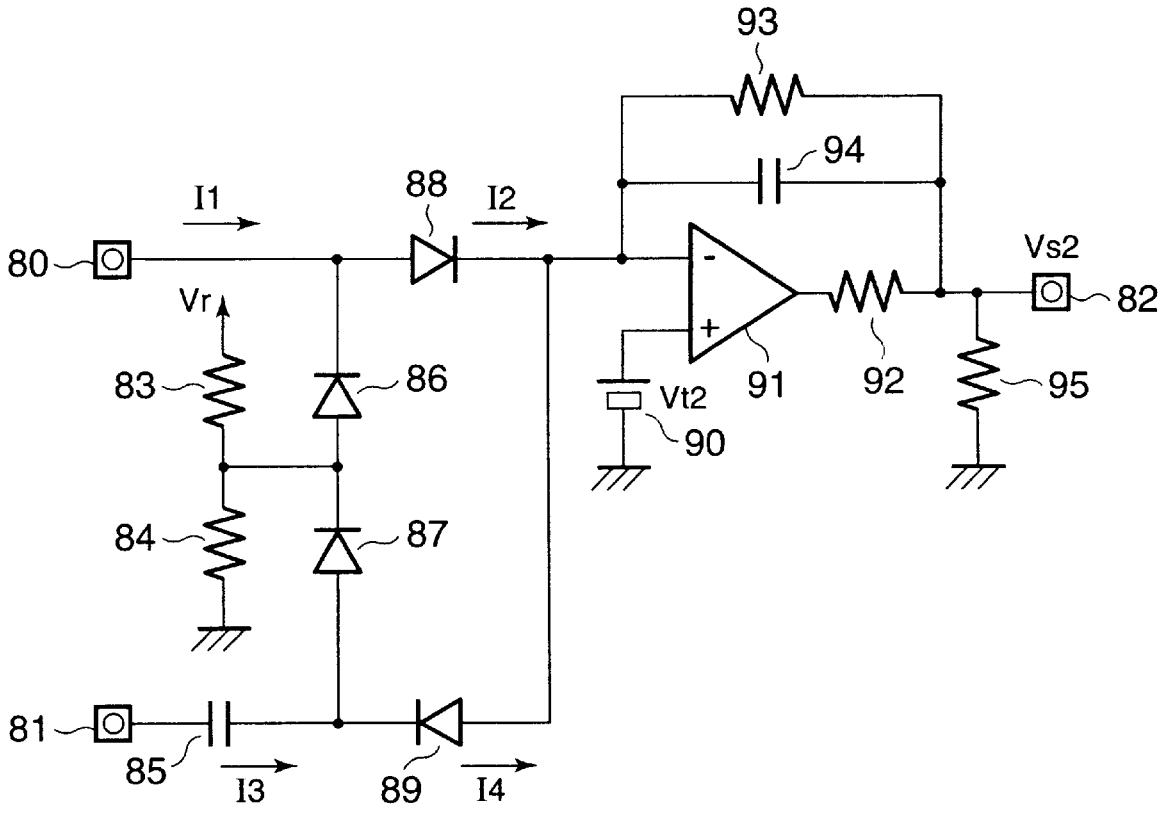
FIG. 22 is an inner circuit diagram of a second developer amount detecting device of the present invention.

FIG. 22 is a diagram showing the inner circuit configuration of the developer amount detecting device 55B. A terminal 80 is connected to the second detecting member 21 via an electric contact (not shown). When a developing AC bias generated in the high-voltage power supply 51 is applied to the developing roller 3, an AC current I1 flows through the terminal 80 due to the capacitance Cs between the second detecting member 21, the developing roller 3, and the developer regulating member supporting member 15. The magnitude of the current I1 is of a value corresponding to the capacitance value Cs. The current I1 is rectified by diodes 86 and 88 provided in the input portion of the terminal 80, and a current I2 obtained through the rectification is input to an integration circuit formed by an operation amplifier 91, a resistor 93, and a capacitor 94. Here, the current I2 is a half-wave current of the current I1.

A terminal 81 is connected to a developing bias output portion (not shown) in the high-voltage power supply 51. That is, the same developing bias as that of the developing roller 3 is applied to the terminal 81. A capacitor 85 of a capacitance Ck is connected to the input portion of the terminal 81. When a developing AC bias is applied thereto, an AC current I3 of a magnitude corresponding to the capacitance Ck flows.

The capacitor 85 is a reference capacitor serving as a measurement reference, and the capacitance value Ck is set at the capacitance value between the second detecting member 21, the developer roller 3, and the developer regulating member supporting member 15 when there is no developer in the process cartridge A. The current I3 is rectified by diodes 87 and 89 set in a direction opposite to that of the input portion of the terminal 80, and a current I4 is input to the integration circuit. The current I4 is a half-wave current of a polarity opposite to that of the current I2. The current I2 and the current I4, which are input to the integration circuit, are integrated, and a DC voltage Vd2 corresponding to the average value of the sum total current of I2 and I4 is generated across the resistor 93. Assuming that the frequency and amplitude of the developing AC bias is fd and Vp, and that the resistance value of the resistor 93 is Rs2, Vd2 can be approximated by the following equation.

$$Vd2=Rs2\times fd\times Vp(Cs-Ck) \quad (3)$$

A predetermined reference voltage Vt2 is input from the power supply 90 to the positive input terminal of the operation amplifier 91, and the output voltage Vs2 of the operation amplifier 91 has a characteristic that can be expressed by the following equation.

$$Vs2=Vt2-Rs2\times fd\times Vp\times(Cs-Ck) \quad (4)$$

As shown in the above equation, the output voltage Vs2 of the operation amplifier is of a value corresponding to the difference between the capacitance between the second detecting member 21, the developing roller 3, and the developer regulating member supporting member 15 and the capacitance of the reference capacitor 85, that is, a voltage value corresponding to the developer amount in the process cartridge A. The output voltage Vs2 of the operation amplifier 91 is output from an output terminal 82. The terminal 82 is connected to the analog-digital converting terminal of the central processing unit in the engine controller 50.

The voltage level Vs2, which corresponds to the developer amount, is converted to digital data and, further, compared with a conversion table previously stored in the engine controller 50, whereby the voltage level Vs2 is converted to the amount T2 of developer in the process cartridge A.

The developer amount T1 detected by the first detecting member 20 and the developer amount T2 detected by the second detecting member 21 are compared with each other inside the engine controller 50, and the user is informed of the value of the developer amount T1 or the developer amount T2 through indication by an indicating portion 54. Further, the value of the developer amount as detected is stored in the process cartridge memory unit 100 (FIG. 3). The indicating portion 54 may be a display provided in the image forming apparatus main body, or the display of a personal computer capable of communication through communication means provided in the image forming apparatus main body.

In the above construction, by providing the first detecting member 20, the second detecting member 21, and the wiping member 13*b*, it is possible to successively detect the developer amount throughout the entire range from the initial to the last stage of use of the process cartridge.

Wiping Member Orientation Regulating Means

As described above, the wiping member 13*b* is provided on the developer conveying member 13. The wiping member 13*b* is in contact with the installation surface of the first detecting member 20, so that, when mounting the developer conveying member 13 in the developer container E, it is necessary to adjust the wiping member 13*b* to a predetermined orientation.

Figure 14:
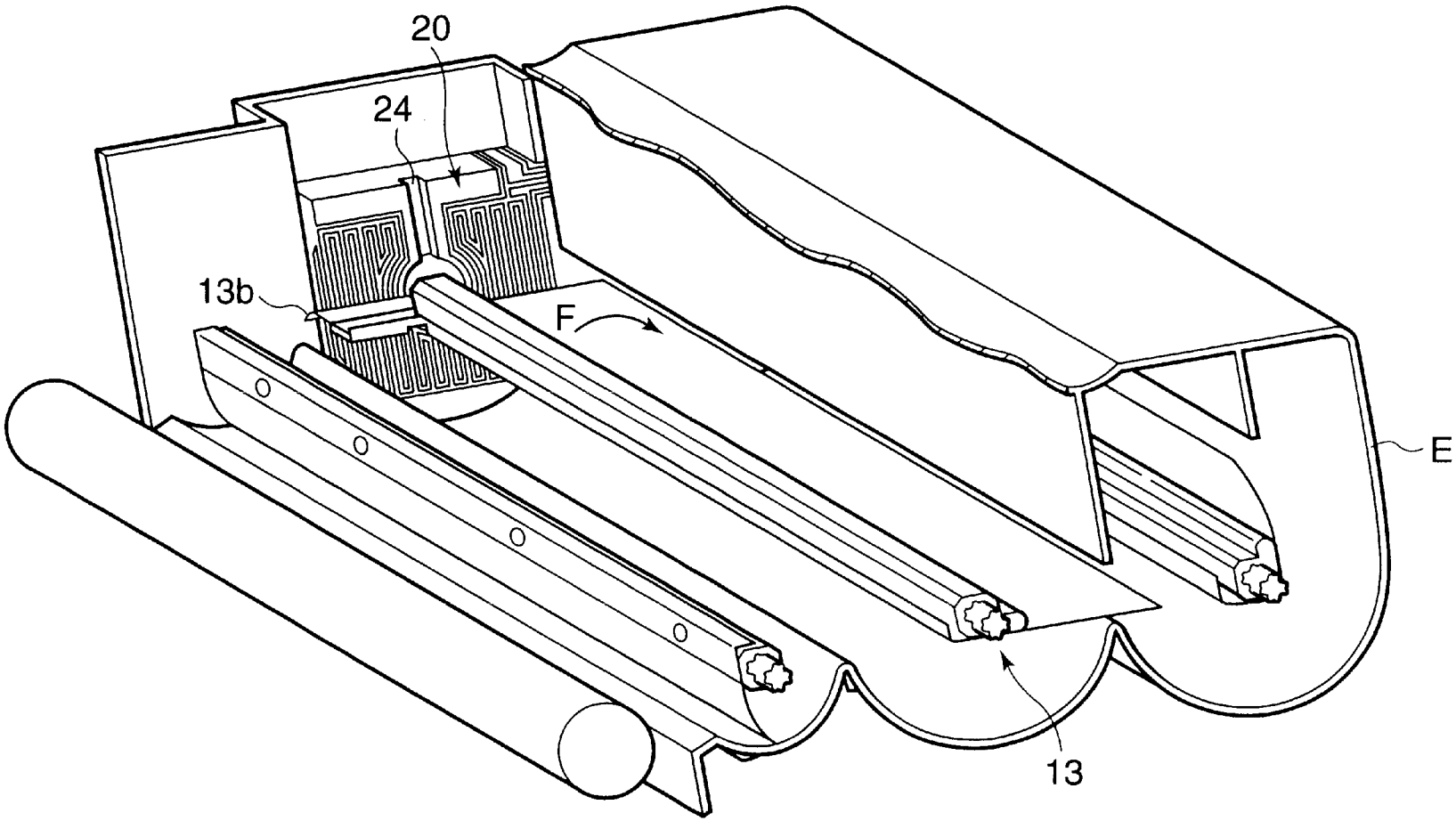
FIG. 14 is a perspective view of a developer container, illustrating how a developer wiping member in the present invention is attached in a predetermined orientation.
Figure 15:
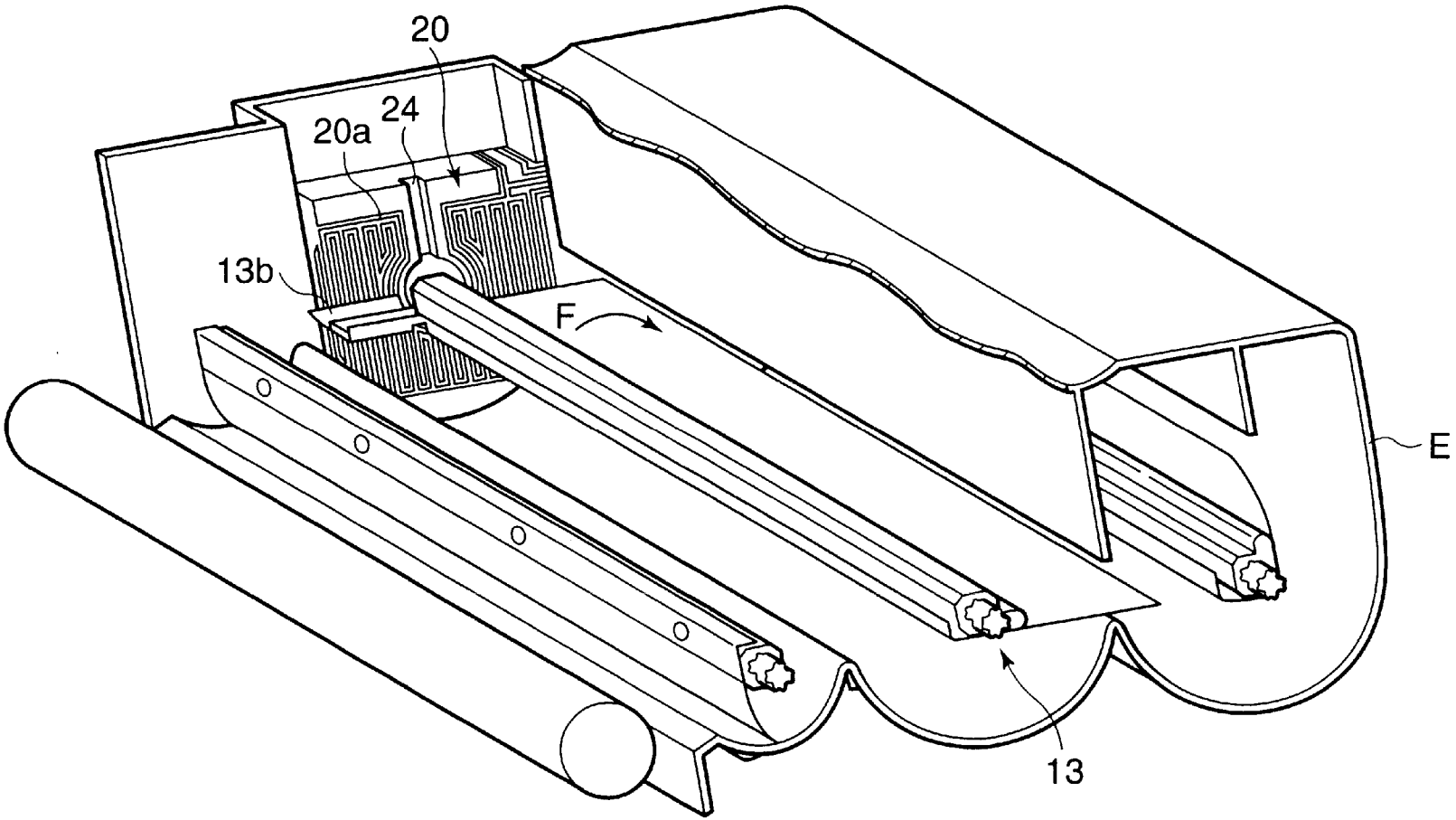
FIG. 15 is a perspective view of the developer container, illustrating how the developer wiping member in the present invention is attached in a wrong orientation.

FIG. 14 shows the case in which the wiping member 13*b* is attached in a predetermined orientation, and FIG. 15 shows the case in which the wiping member 13*b* is disoriented. In FIG. 14, the wiping member 13*b* or the sheet is oriented downstream in the rotating direction indicated by an arrow F, and, in FIG. 15, the wiping sheet 13*b* is oriented upstream in the rotating direction indicated by the arrow F.

When the operator pays no particular attention to the orientation of the wiping member when it is mounted, there is no knowing whether the orientation of the wiping sheet is that of FIG. 14 or that of FIG. 15. However, to stabilize the wiping operation, it is necessary to select one of the above two orientations and maintain the wiping sheet in that orientation.

In view of this, in the present invention, there is formed on the surface to which the first detecting member is glued wiping member orientation regulating means serving as means for regulating the orientation of the wiping member to a predetermined orientation.

In this embodiment, there is provided on the surface to which the first detecting member 20 is glued the wiping member orientation regulating means 24 in the form of a recess or protrusion. As the developer conveying member 13 rotates, the wiping member 13*b* is caught by the regulating means 24, whereby it is possible to adjust the wiping member 13*b*, which has been in the wrong orientation shown in FIG. 15, to the predetermined orientation shown in FIG. 14.

Figure 16:
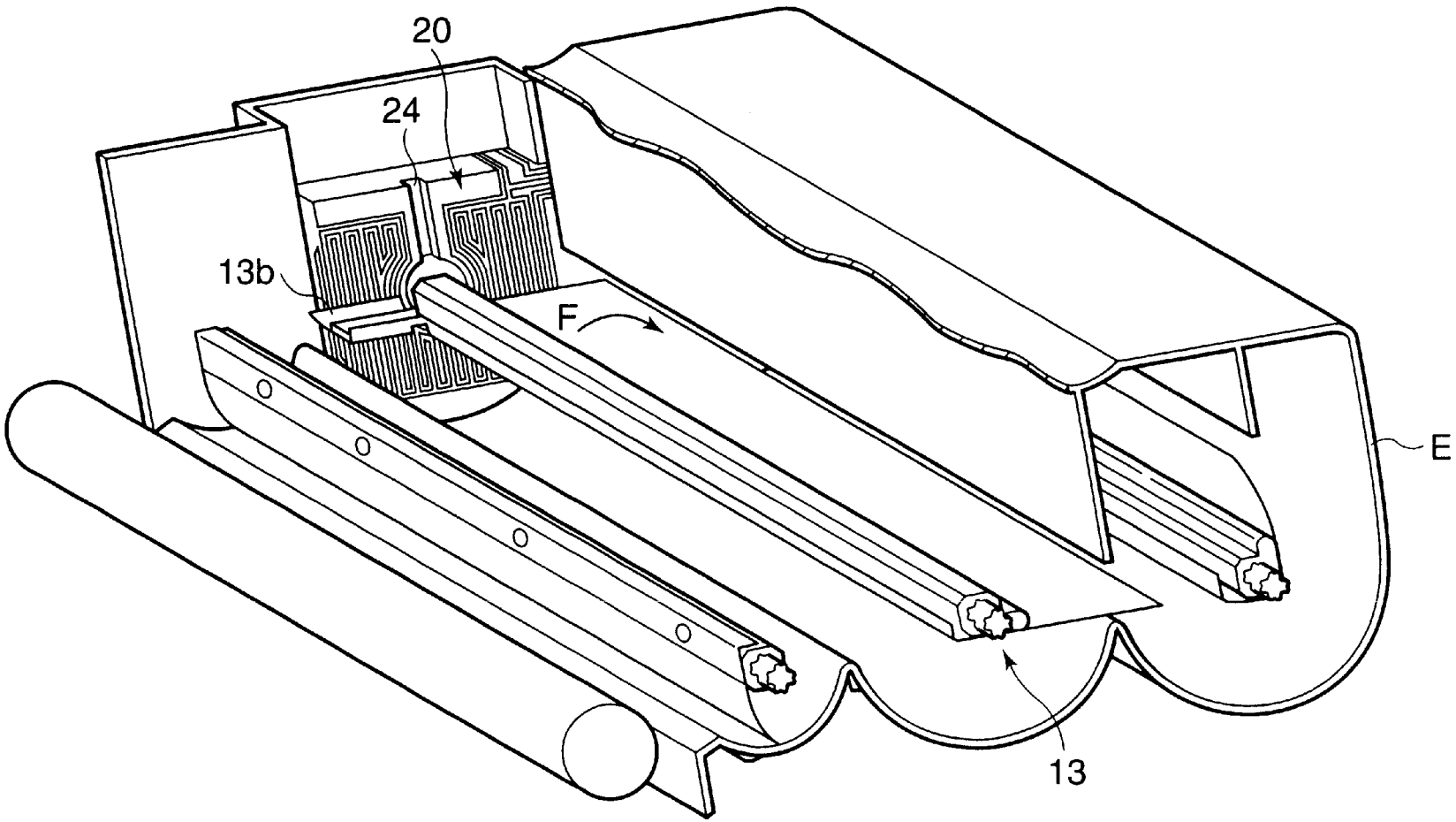
FIG. 16 is a perspective view of the developer container, illustrating the function of an orientation regulating means for the developer wiping member of the present invention.
Figure 17:
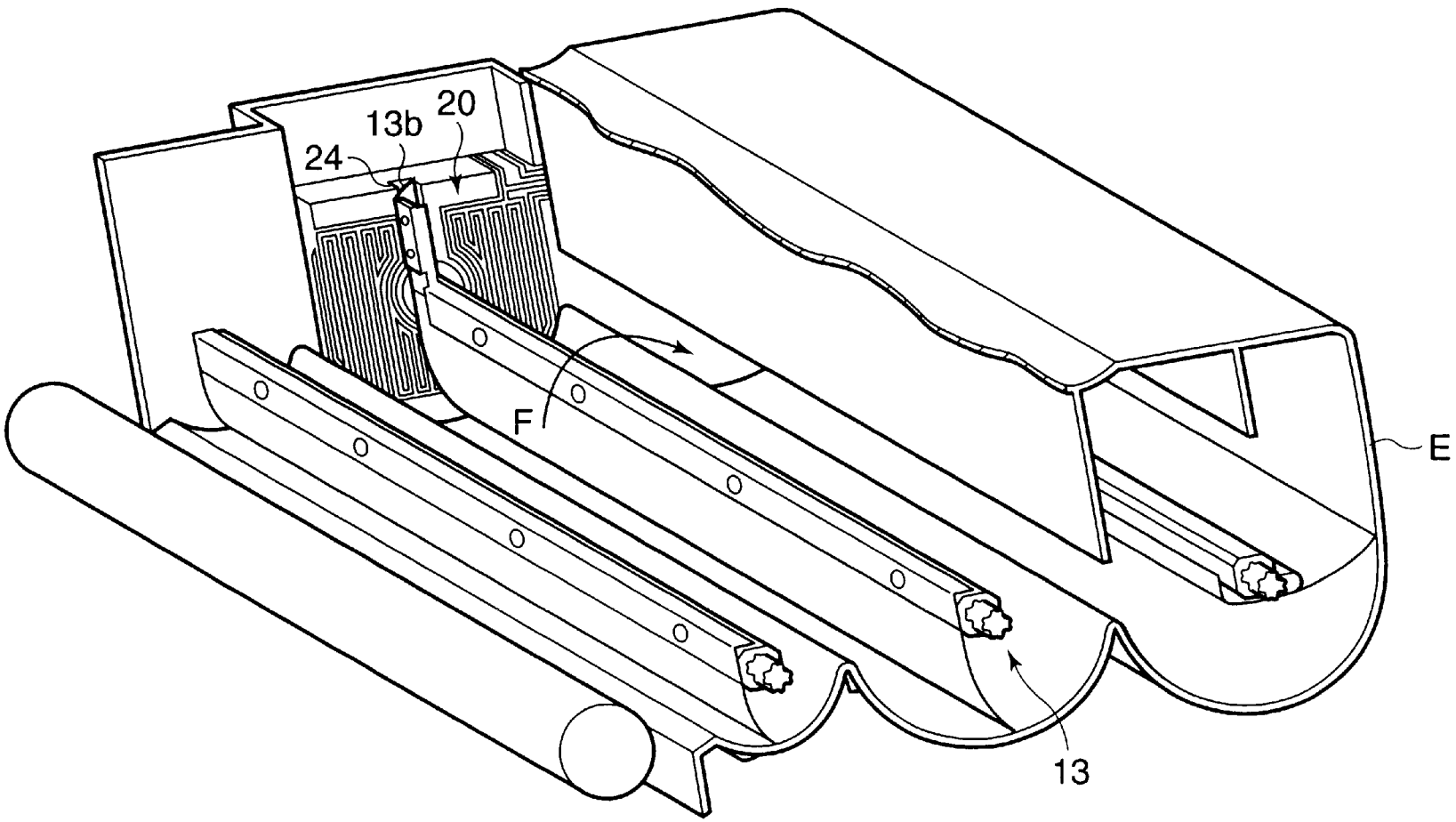
FIG. 17 is a perspective view of the developer container, illustrating the function of the orientation regulating means for the developer wiping member of the present invention.
Figure 18:
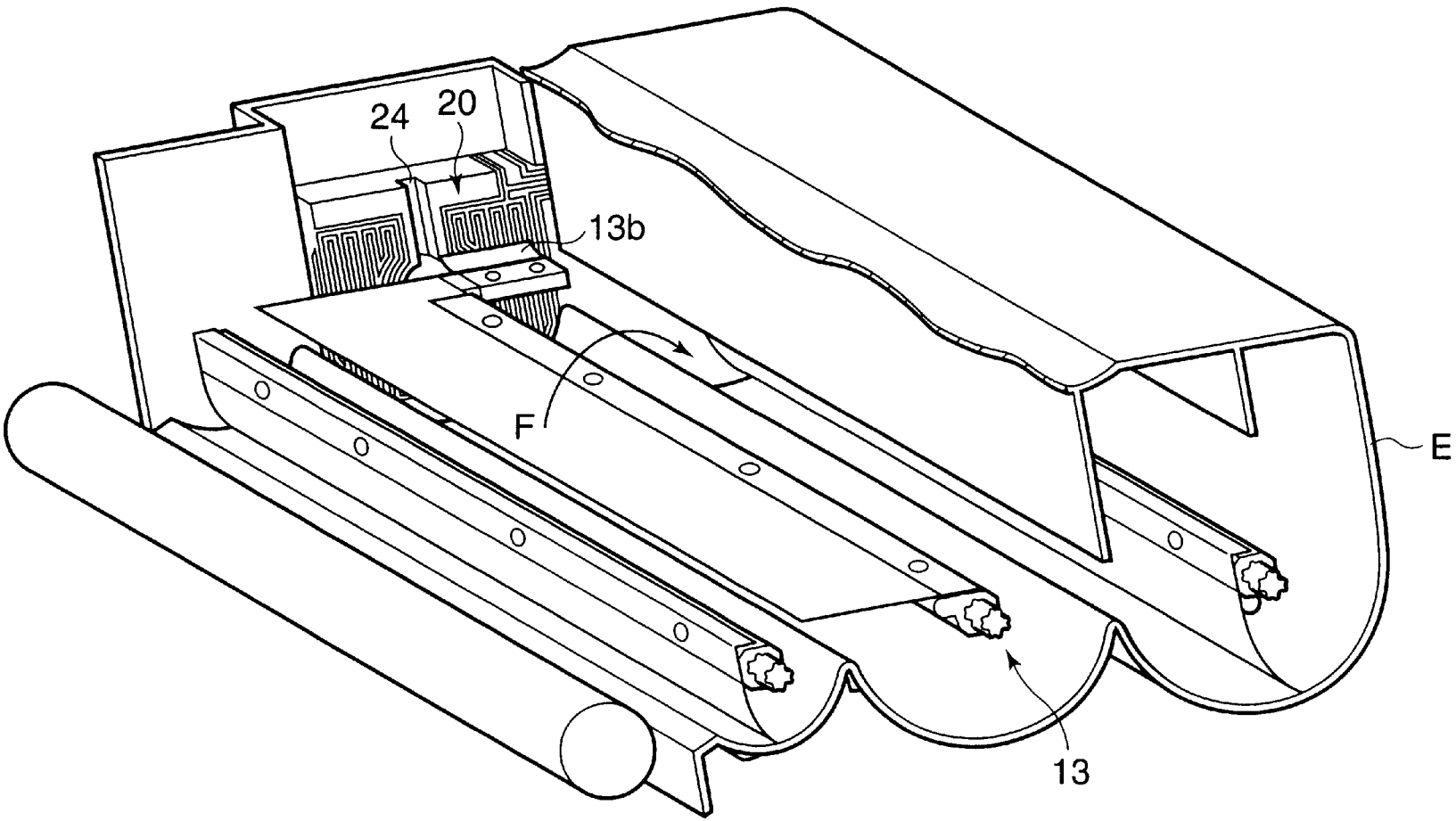
FIG. 18 is a perspective view of the developer container, illustrating the function of the orientation regulating means for the developer wiping member of the present invention.

FIGS. 16 through 18 are operation diagrams. It is to be assumed that there is provided in the surface to which the first detecting member is glued the wiping member orientation regulating means 24 in the form of a recess.

First, in the state as shown in FIG. 16, assembly has been conducted with the wiping member disoriented. When the conveying member 13 rotates, the distal end of the wiping member 13*b* is caught by the wiping member orientation regulating means 24 and retained therein, the conveying member 13 further rotating. Once the wiping member 13*b* has passed the wiping member orientation regulating means 24, the wiping member 13*b* is put in the state as shown in FIG. 18, i.e., oriented downstream in the rotating direction F. Thereafter, wiping can be effected in a stable manner in the predetermined direction.

Figure 19:
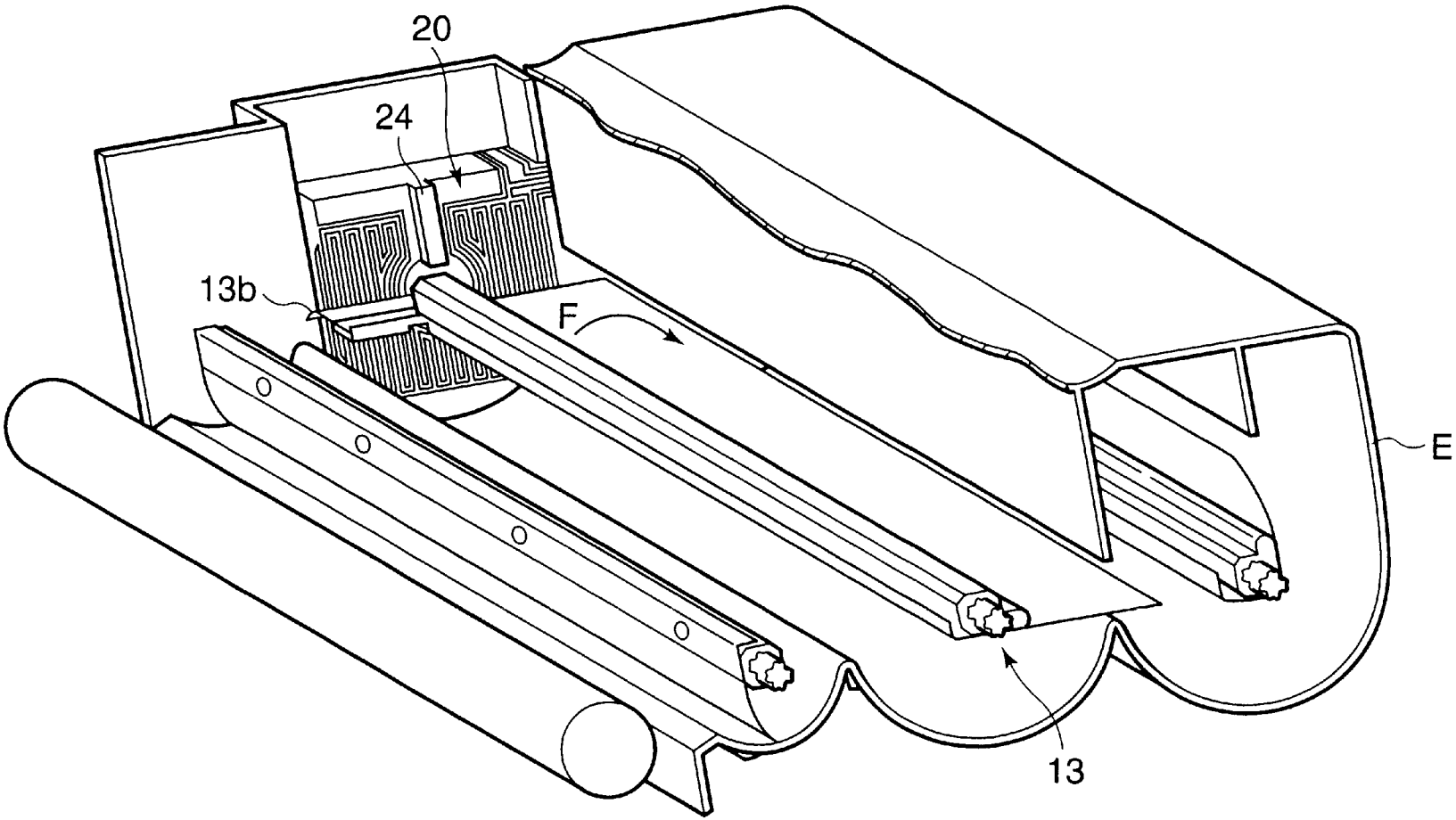
FIG. 19 is a perspective view of a developer container, illustrating another embodiment of the orientation regulating means for the developer wiping member of the present invention.

Further, as shown in FIG. 19, the wiping member orientation regulating means 24 functions in the same way if it is in the form of a protrusion. In this regard, any configuration will do as long as it has a portion adapted to catch the distal end of the wiping member 13*b*.

As described above, by forming a wiping member orientation regulating portion in the surface to which the first detecting member is glued, there is no need to adjust the position of the wiping member when attaching the conveying member, thereby achieving an improvement in terms of efficiency in assembling.

Second Embodiment

While the first embodiment has been described with reference to a process cartridge A or an image forming apparatus provided with the process cartridge A, the principle of the present invention is also applicable to a developing device which is formed by removing the photosensitive drum 1, the charging means, and the cleaning means 8 from the process cartridge A.

That is, the developer container E and the developer amount detecting system described as the first embodiment are also applicable to a developing device which includes a developer bearing member, a developer container, etc. and which is adapted to develop an electrostatic latent image formed on an electrophotographic photosensitive member, making it possible to achieve the same effect as that of the first embodiment.

As described above, in accordance with the present invention, (1) It is possible to effectively remove developer adhering to the detection region of the detecting member capable of successively detecting the remaining amount of developer;

(2) When performing assembly, there is no need for the operator to adjust the attaching orientation of the developer removing member to thereby achieve an improvement in terms of the efficiency of the assembly operation; and (3) If the developer removing member is held in contact with the detection region of the detecting member in an orientation different from a predetermined orientation, it is possible to correct the orientation by rotating the developer removing member to thereby achieve an improvement in terms of the efficiency of the assembly operation.

While the invention has been described with reference to the structure disclosed herein, it is not confined to the details set forth and this application is intended to cover such modifications or changes as may come within the purposes of the improvements or the scope of the following claims.

What is claimed is:

1. A developer container for containing a developer, comprising:

(a) a detecting member for detecting a developer amount having an electrode member having a pair of input-side and output-side electrodes formed in parallel and in one plane at a predetermined interval for detecting the capacitance between the electrodes, a measurement-side electrode that is in contact with the developer, and a reference electrode that is out of contact with the developer, the detecting member being provided on a side surface of the developer container;

(b) a developer removing member for removing developer adhering to a detection surface of the detecting member;

(c) a developer conveying member for conveying the developer toward a developer bearing member, the developer removing member being attached to the developer conveying member and in contact with the detection surface of the detecting member so as to remove developer on the detection surface of the detecting member; and (d) an acting member acting by a torque of the developer removing member such that the developer removing member is held in contact with the detection surface in a predetermined orientation.

2. A developer container according to claim 1, wherein the developer removing member is a wiping member whose distal end is in contact with the detection surface of the detecting member, and wherein the distal end is oriented in a predetermined direction with respect to a moving direction of the wiping member.

3. A developer container according to claim 1, wherein the acting member is formed as a recess.

4. A developer container according to claim 1, wherein the acting member is formed as a protrusion.

5. A developer container according to claim 1, wherein the acting member is formed in the side surface on which the detecting member is provided.

6. An electrophotographic image forming apparatus for forming an image on a recording medium, comprising:

(a) an electrophotographic photosensitive member;

(b) electrostatic latent image forming means for forming an electrostatic latent image on the electrophotographic photosensitive member; and (c) a developer container according to any one of claims 1 through 5.

7. A process cartridge which is detachably mountable in a main body of an electrophotographic image forming apparatus, the process cartridge comprising:

(a) an electrophotographic photosensitive member;

(b) process means acting on the electrophotographic photosensitive member; and (c) a developer container according to any one of claims 1 through 5.

8. A developing device for use in an electrophotographic image forming apparatus, the developing device comprising:

(a) a developer container according to any one of claims 1 through 5; and (b) a developer bearing member for developing an electrostatic latent image formed on an electrophotographic photosensitive member by using a developer contained in the developer container.

9. A developer container for use in an electrophotographic image forming apparatus, the developer container comprising:

(a) a developer containing portion for containing a developer;

(b) a detecting member including a first capacitance generating portion which is provided at a position where the first capacitance generating portion is in contact with developer when a predetermined amount of developer is contained in the developer containing portion for generating a capacitance in correspondence with an amount of developer when a voltage is applied to the first capacitance generating portion, and a second capacitance generating portion which is provided at a position where the second capacitance generating portion is out of contact with the developer contained in the developer containing portion for generating a reference capacitance when a voltage is applied to the second capacitance generating portion to thereby detect the amount of developer contained in the developer containing portion by a main body of the electrophotographic image forming apparatus, with the developer container being mounted to the main body of the electrophotographic image forming apparatus;

(c) an electric contact for transmitting to the main body of the electrophotographic image forming apparatus a first electric signal which is in correspondence with the capacitance generated when the voltage is applied to the first capacitance generating portion from the main body of the electrophotographic image forming apparatus, with the developer container being mounted to the main body of the electrophotographic image forming apparatus, and a second electric signal which is in correspondence with the capacitance generated when the voltage is applied to the second capacitance generating portion from the main body of the electrophotographic image forming apparatus;

(d) a developer removing member for removing developer adhering to a detection surface of the detecting member; and (e) an acting member for acting by a torque of the developer removing member such that the developer removing member is held in contact with the detection surface in a predetermined orientation.

10. A process cartridge which is detachably mountable to a main body of an electrophotographic image forming apparatus, the process cartridge comprising:

(a) an electrophotographic photosensitive member;

(b) a developing member for developing an electrostatic latent image formed on the electrophotographic photosensitive member;

(c) a developer containing portion for containing a developer to be used to develop the electrostatic latent image formed on the electrophotographic photosensitive member;

(d) a detecting member including a first capacitance generating portion which is provided at a position where the first capacitance generating portion is in contact with developer when a predetermined amount of developer is contained in the developer containing portion for generating a capacitance in correspondence with an amount of developer when a voltage is applied to the first capacitance generating portion, and a second capacitance generating portion which is provided at a position where the second capacitance generating portion is out of contact with the developer contained in the developer containing portion for generating a reference capacitance when a voltage is applied to the second capacitance generating portion to thereby detect the amount of developer contained in the developer containing portion by the main body of the electrophotographic image forming apparatus, with the process cartridge being mounted to the main body of the electrophotographic image forming apparatus;

(e) an electric contact for transmitting to the main body of the electrophotographic image forming apparatus a first electric signal which is in correspondence with the capacitance generated when the voltage is applied to the first capacitance generating portion from the main body of the electrophotographic image forming apparatus, with the process cartridge being mounted to the main body of the electrophotographic image forming apparatus, and a second electric signal which is in correspondence with the capacitance generated when the voltage is applied to the second capacitance generating portion from the main body of the electrophotographic image forming apparatus;

(f) a developer removing member for removing developer adhering to a detection surface of the detecting member; and (g) an acting member acting by a torque of the developer removing member such that the developer removing member is held in contact with the detection surface in a predetermined orientation.

11. A developer container for containing a developer and for use in an electrophotographic image forming apparatus, said developer container comprising:

(a) a detecting member for detecting a developer amount by a main body of said apparatus detecting a change in a value of capacitance corresponding to the developer amount;

(b) a developer removing member for removing developer adhering to a surface of said detecting member by rotating in contact with the surface of said detecting member; and (c) an acting member for acting on said developer removing member to direct said developer removing member in contact with said detecting member in a predetermined direction using a torque of said developer removing member if said developer removing member in contact with said detecting member is not directed in the predetermined direction, wherein said acting member is arranged within a rotating region of said developer removing member.

12. A developer container according to claim 11, wherein a distal end of said developer removing member, which is rotating, is caught by said acting member, and said developer removing member further rotates to pass said acting member so that said developer removing member in contact with said detecting member is directed in the predetermined direction.

13. A developer container according to claim 12, wherein said acting member is a recess or a protrusion by which the distal end of said developer removing member, which is rotating, is caught.

14. A developer container according to claim 11, 12, or 13, wherein said developer removing member rotates by receiving a rotation driving force from a developer conveying member for conveying the developer.

15. A developer container according to claim 14, wherein said detecting member has an electrode member having a pair of input-side and output-side electrodes formed in parallel and in one plane at a predetermined interval for detecting the capacitance between the electrodes, a measurement-side electrode that is in contact with the developer, and a reference electrode that is out of contact with the developer, said detecting member being provided on a side surface of said developer container.

16. A process cartridge detachably mountable to a main body of an electrophotographic image forming apparatus, said process cartridge comprising:

(a) an electrophotographic photosensitive member;

(b) a developing member for developing an electrostatic latent image formed on said electrophotographic photosensitive member by using developer; and (c) a developer container for containing the developer, said developer container comprising:

(i) a detecting member for detecting a developer amount by said main body of said apparatus detecting a change in a value of capacitance corresponding to the developer amount;

(ii) a developer removing member for removing the developer adhering to a surface of said detecting member by rotating in contact with the surface of said detecting member; and (iii) an acting member for acting on said developer removing member to direct said developer removing member in contact with said detecting member in a predetermined direction using a torque of said developer removing member if said developer removing member in contact with said detecting member is not directed in the predetermined direction, wherein said acting member is arranged within a rotating region of said developer removing member.

17. A process cartridge according to claim 16, wherein a distal end of said developer removing member, which is rotating, is caught by said acting member, and said developer removing member further rotates to pass said acting member so that said developer removing member in contact with said detecting member is directed in the predetermined direction.

18. A process cartridge to claim 17, wherein said acting member is a recess or a protrusion by which the distal end of said developer removing member, which is rotating, is caught.

19. A process cartridge according to claim 16, 17, or 18, wherein said developer removing member rotates by receiving a rotation driving force from a developer conveying member for conveying the developer.

20. A process cartridge according to claim 19, wherein said detecting member has an electrode member having a pair of input-side and output-side electrodes formed in parallel and in one plane at a predetermined interval for detecting the capacitance between the electrodes, a measurement-side electrode that is in contact with the developer, and a reference electrode that is out of contact with the developer, said detecting member being provided on a side surface of said developer container.

* * * * *

UNITED STATES PATENT AND TRADEMARK OFFICE

CERTIFICATE OF CORRECTION

PATENT NO. : 6,505,008 B2
DATED : January 7, 2003
INVENTOR(S) : Daisuke Abe

It is certified that error appears in the above-identified patent and that said Letters Patent is hereby corrected as shown below:

Column 17,
Line 1, "to" should read -- according to --.

Signed and Sealed this

Second Day of December, 2003

JAMES E. ROGAN
*Director of the United States Patent and Trademark Office*